US010142761B2

(12) United States Patent
Brown et al.

(10) Patent No.: US 10,142,761 B2
(45) Date of Patent: Nov. 27, 2018

(54) STRUCTURAL MODELING OF THE HEAD RELATED IMPULSE RESPONSE

(71) Applicant: Dolby Laboratories Licensing Corporation, San Francisco, CA (US)

(72) Inventors: C. Phillip Brown, Castro Valley, CA (US); Matthew Fellers, San Francisco, CA (US); Regunathan Radhakrishnan, Foster City, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 11 days.

(21) Appl. No.: 15/123,934

(22) PCT Filed: Mar. 4, 2015

(86) PCT No.: PCT/US2015/018812

§ 371 (c)(1),
(2) Date: Sep. 6, 2016

(87) PCT Pub. No.: WO2015/134658

PCT Pub. Date: Sep. 11, 2015

(65) Prior Publication Data

US 2017/0094440 A1 Mar. 30, 2017

Related U.S. Application Data

(60) Provisional application No. 61/948,849, filed on Mar. 6, 2014.

(51) Int. Cl.
*H04S 7/00* (2006.01)
*H04S 1/00* (2006.01)

(52) U.S. Cl.
CPC ..... *H04S 7/304* (2013.01); *H04S 1/007* (2013.01); *H04S 2400/11* (2013.01); *H04S 2420/01* (2013.01)

(58) Field of Classification Search
CPC .... G10L 19/008; H04S 3/008; H04S 2400/11; H04S 2400/03; H04S 2420/03; H04S 2420/01

(Continued)

(56) References Cited

U.S. PATENT DOCUMENTS 4,817,149 A 3/1989 Myers
5,073,936 A 12/1991 Gorike (Continued)

FOREIGN PATENT DOCUMENTS

CN 101909236 12/2010
EP 0959644 11/1999

(Continued)

OTHER PUBLICATIONS

Dude, Richard O. "Estimating Azimuth and Elevation from the Interaural Intensity Difference," Technical Report No. NSF Grant No. IRI-9214233, Dept. of Elec. Engr., San Jose State Univ., (Sep. 1993).

(Continued)

*Primary Examiner* — Alexander Jamal

(57) ABSTRACT

A method for creating a head-related impulse response (HRIR) for use in rendering audio for playback through headphones comprises receiving location parameters for a sound including azimuth, elevation, and range relative to a head of a listener, applying a spherical head model to the azimuth, elevation, and range input parameters to generate binaural HRIR values, computing a pinna model using the azimuth and elevation parameters to apply to the binaural HRIR values to pinna modeled HRIR values, computing a torso model using the azimuth and elevation parameters to apply to the pinna modeled HRIR values to generate pinna and torso modeled HRIR values, and computing a near-field model using the azimuth and range parameters to apply to the pinna and torso modeled HRIR values to generate pinna, torso and near-field modeled HRIR values.

20 Claims, 17 Drawing Sheets

(58) Field of Classification Search
USPC ..... 381/307, 310, 17, 22, 23
See application file for complete search history.

(56) References Cited

U.S. PATENT DOCUMENTS

| | | | | |
|---|---|---|---|---|
| 5,729,612 | A | 3/1998 | Abel | |
| 6,118,875 | A | 9/2000 | Moller | |
| 6,223,090 | B1 | 4/2001 | Brungart | |
| 6,795,556 | B1 | 9/2004 | Sibbald | |
| 6,996,244 | B1 * | 2/2006 | Slaney ..... | H04S 1/002 381/17 |
| 7,085,393 | B1 | 8/2006 | Chen | |
| 7,158,642 | B2 | 1/2007 | Tsuhako | |
| 7,333,622 | B2 | 2/2008 | Algazi | |
| 7,386,133 | B2 | 6/2008 | Hess | |
| 7,391,876 | B2 | 6/2008 | Cohen | |
| 8,027,476 | B2 | 9/2011 | Miura | |
| 8,428,269 | B1 | 4/2013 | Brungart | |
| 2003/0202665 | A1 | 10/2003 | Lin | |
| 2006/0013409 | A1 | 1/2006 | Desloge | |
| 2009/0041254 | A1 | 2/2009 | Jin | |
| 2009/0046864 | A1 | 2/2009 | Mahabub | |
| 2010/0191537 | A1 | 7/2010 | Breebaart | |
| 2011/0243338 | A1 | 10/2011 | Brown | |
| 2011/0286601 | A1 | 11/2011 | Fukui | |
| 2012/0093330 | A1 | 4/2012 | Napoletano | |
| 2012/0213375 | A1 | 8/2012 | Mahabub | |
| 2013/0121516 | A1 * | 5/2013 | Lamb ..... | H04S 3/00 381/307 |
| 2014/0198918 | A1 * | 7/2014 | Li ..... | H04S 7/30 381/26 |
| 2017/0094440 | A1 * | 3/2017 | Brown ..... | H04S 7/304 |
| 2017/0289728 | A1 * | 10/2017 | Yamashita ..... | G06F 21/32 |

FOREIGN PATENT DOCUMENTS

| | | |
|---|---|---|
| GB | 2369976 | 6/2002 |
| KR | 10-0818660 | 4/2008 |
| WO | 00/01200 | 1/2000 |
| WO | 2005/089360 | 9/2005 |
| WO | 2007/083937 | 7/2007 |

OTHER PUBLICATIONS

Blauert, P. Spatial Hearing (Revised edition). Cambridge, MA: MIT Press, 1997.

Carlile, S, "The physical basis and psychophysical basis of sound localization" in S. Carlile, ed., Virtual Auditory Space: Generation and Applications., pp. 27-78. Austin, TX: R. G. Landes Company, 1996.

Kistler, D.J. et al "A model of head-related transfer functions based on principal components analysis and minimum-phase reconstruction" J. Acoust. Soc. Am., vol. 91, pp. 1637-1647, Mar. 1992.

Wenzel, E.M. et al Localization using nonindividualized head-related transfer functions, J. Acoust. Soc. Am., vol. 94, pp. 111-123, Jul. 1993.

Brown, C.P. et al. "An efficient HRTF model for 3-D Sound" in WASPAA '97 (1997 IEEE ASSP Workshop on Applications of Signal Processing to Audio and Acoustics, Mohonk Mountain House, New Paltz, NY, Oct. 1997.

Duda, R.O. "Modeling head related transfer functions", Proc. Twenty-Seventh Annual Asilomar Conference on Signals, Systems and Computers. Asilomar, CA, Nov. 1993.

Shinn-Cunningham, B. et al. Recent developments in virtual auditory space, in S. Carlile, Virtual Auditory Space: Generation and Applications., pp. 185-243. Austin, TX: R. G. Landes Company, 1996.

Bloom, P.J. "Creating source elevation illusions by spectral manipulation" J. Audio Eng. Soc., vol. 25, No. 9, pp. 560-565, 1977.

Watkins, A.J. "Psychoacoustical aspects of synthesized vertical locale cues" J. Acoust. Soc. Am., vol. 63, pp. 1152-1165, Apr. 1978.

Algazi, V.R. et al "The use of head-and-torso models for improved spatial sound synthesis," in Proc. 113th Convention of the Audio Engineering Society, (Los Angeles, CA, USA), 2002.

Satarzadeh, P. et al "Physical and filter pinna models based on anthropometry," Paper 7098, 122nd Convention of the Audio Engineering Society, Vienna, Austria (May 2007).

Strutt, J.W.(Lord Rayleigh), "On the acoustic shadow of a sphere", Phil. Transact. Roy. Soc. London, vol. 203A, pp. 87-97, 1904. (See also The Theory of Sound. London: Macmillan, 1877; second edition republished by Dover Publications, NY, 1945.

Woodworth, R.S. et al "Experimental Psychology", pp. 349-361. Holt, Rinehard and Winston, NY, 1962.

Kuhn, G.F. "Model for the interaural time differences in the azimuthal plane", J. Acoust. Soc. Am., vol. 62, No. 1, pp. 157-167, Jul. 1977.

Batteau, D.W. "The role of the pinna in human localization", Proc. Royal Society London, vol. 168 (series B), pp. 158-180, 1967.

Searle, C.L. "Model for for Auditory Localizaton" J. Acoust. Soc. Am. vol. 60, Issue 5, pp. 1164-1175 (1976).

Wightman, F.L. et al "Headphone Simulation of Freefield Listening. II Phsychophysical Validation" J. Acoust Soc Am. Feb. 1989;85(2):868-78.

Kulkarni A. et al. "On the Minimum-Phase Approximation of Head-Related Transfer Functions" IEEE ASSP Workshop on Applications of Signal Processing to Audio and Acoustics, 1995.

Spagnol S. et al "Fitting Pinna-Related Transfer Functions to Anthropometry for Binaural Sound Rendering" 2010 IEEE International Workshop on Multimedia Signal Processing (MMSP). Oct. 4-6, 2010.

McAulay, R.J. et al "Speech Analysis/Synthesis Based on Sinusoidal Representation," IEEE Transactions on Acoustics, Speech, and Signal Processing, vol. 34, No. 4, pp. 744-754, 1986.

Algazi, V.R. et al "The CIPIC HRTF Database." IEEE Workshop on the Applications of Signal Processing to Audio and Acoustics, 2001, pp. 99-102.

Duda, Richard O. "Estimating Azimuth and Elevation from the Interaural Intensity Difference," Technical Report No. 4, NSF Grant No. IRI-9214233, Dept. of Elec. Engr., San Jose State Univ., (Sep. 1993).

Qu, T. et al. "Distance-dependent Head-related Transfer Functions Measured with High Spatial Resolution Using a Spark Gap", IEEE Trans. on Audio, Speech and Language Processing, 17(6), 1124-1132, 2009.

Wightman, F.L. et al "Headphone simulation of free-field listening II: Psychophysical validation," Joumal of the Acoustical Society of America, 85(2), 868-878, 1989.

Spagnol, S. et al. "Structural Modeling of PinnaRelated Transfer Functions for 3D Sound Rendering" Retrieved from http://www.dei.unipd.it/~avanzini/downloads/paper/spagnol_cim10-11.pdf, 2010.

Geronazzo, M. et al "Customized 3D Sound for Innovative Interaction Design" retrieved from http://www.dei.unipd.ti/~avanzini/downloads/paper/geronazzo_chitaly11_ecopy.pdf, 2011.

Geronazzo, M. et al "A Head-Related Transfer Function Model for Real-Time Customized 3D Sound Rendering" 2011 Seventh International Conference on Signal Image Technology & Internet Based Systems, 2011.

Geronazzo, M. et al "A Standardized Repository of Head-Related and Headphone Impulse Response Data" AEC convention 134, May 4-7, 2013, pp. 1-7.

Geronazzo, M. et al "A Modular Framework for the Analysis and Synthesis of Head-Related Transfer Functions" presented at the 134th Convention, May 4-7, 2013, Rome, Italy, pp. 1-10.

Romigh, Griffin D. "Individualized Head-Related Transfer Functions: Efficient Modeling and Estimation from Small Sets of Spatial Samples" Carnegie Mellon University, UMI Dissertations Publishing, 2012.

Fink, Kimberly J. "Modeling and Individualization of Head-related Transfer Functions Using Principal Component Analysis" Dartmouth College, ProQuest, UMI Dissertations Publishing, 2012.

(56) References Cited

OTHER PUBLICATIONS

Faller II, Kenneth John et al "Time and Frequency Decomposition of Head-Related Impulse Responses for the Development of Customizable Spatial Audio Models" WSEAS Transactions on Signal Processing, Nov. 2006, pp. 1465-1472.
Faller II, Kenneth John, "Decomposition and Modeling of Head-Related Transfer Functions Towards Interactive Customization of Binaural Sound Systems" WSEAS transactions on Signal Processing Dec. 2005, pp. 354-361.
Gupta, Navarun "Structure-Based Modeling of Head-Related Transfer Functions Towards Interactive Customization of Binaural Sound Systems" Florida International University, ProQuest, Umi Dissertations Publishing, 2003.
Raykar, V. et al "Extracting the Frequencies of the Pinna Spectral Notches in Measured Head Related Impulse Responses" Journal of the Acoustical Society of America, v. 118, No. 1, pp. 364-374, Jul. 2005.
Anonymous "Model-Based HRTF Parameter Interpolation" ip.com Electronic Publication, Sep. 5, 2006.
Spagnol, S. et al "On the Relation Between Pinna Reflection Patterns and Head-Related Transfer Function Features" IEEE Transactions on Audio, Speech, and Language Processing, vol. 21, Issue 3, Mar. 2013, pp. 508-519.
Mokhtari, P. et al "Pinna Sensitivity Patterns Reveal Reflecting and Diffracting Surfaces that Generate the First Spectral Notch in the Front Median Plane" IEEE International Conference on Acoustics, Speech and Signal Processing, pp. 2408-2411, May 22-27, 2011.
Spors, S. et al "Efficient Range Extrapolation of Head-Related Impulse Responses by Wave Field Synthesis Techniques" IEEE International Conference on Acoustics, Speech and Signal Processing, pp. 49-52, May 22-27, 2011.
Duda, R.O. et al "Range-Dependence of the HRTF for a Spherical Head" IEEE ASSP Workshop on Applications of Signal Processing to Audio and Acoustics, Oct. 19-22, 1997, pp. 1-5.
Pollow, M. et al "Calculation of Head-Related Transfer Functions for Arbitrary Field Points Using Spherical Harmonics Decomposition" Acta Acustica United with Acustica, vol. 98, No. 1, Jan./Feb. 2012, pp. 12-82.
Geronazzo, M. et al "Estimation and Modeling of Pinna-Related Transfer Functions" Proc. of the 13th Int. Conference on Digital Audio Effects, Graz, Austria, Sep. 6-10, 2010, pp. 1-8.
Barreto, A. et al "Dynamic Modeling of the Pinna for Audio Spatialization" WSEAS Transactions on Acoustics and Music, 2004, pp. 1-6.
Geronazzo, M. et al "Mixed Structural Modeling of Head-Related Transfer Functions for Customized Binaural Audio Delivery" IEEE 18th International Conference on Digital Signal Processing, Jul. 1, 2013, pp. 1-8.
Chan, Cheng-Ta et al "A 3D Sound Using the Adaptive Head Model and Measured Pinna Data" IEEE International Conference on Multimedia and Expo, vol. 2, Jul. 30, 2000, pp. 807-810.
Spagnol, S. et al "Hearing Distance: A Low-Cost Model for Near-Filed Binaural Effects" 20th European Signal Processing Conference, Aug. 27-31, 2012, pp. 2030-2034.
Brown, C. Phillip et al "A Structural Model for Binaural Sound Synthesis" IEEE Transactions on Speech and Audio Processing, vol. 6, No. 5, Sep. 1998, pp. 476-488.
Merimaa, J. et al "Individual Perception of Headphone Reproduction Asymmetry" AEC Convention 131, Oct. 20-23, 2011, New York, USA, pp. 1-10.
Spagnol, S. et al "A Single-Azimuth, Pinna-Related Transfer Function Database" Proc. of the 14th International Conference on Digital Audio Effects, Sep. 19, 2011, pp. 209-212.
R.O. Duda, "Elevation Dependence of the Interaural Transfer Function", in Binaural and Spatial hearing in Real and Virtual Environments by R.H. Gilkey and T.R Anderson, Eds.) pp. 49-75 (Hillsdale, NJ: Lawrence Erlbaum, 1997).

* cited by examiner

STRUCTURAL MODELING OF THE HEAD RELATED IMPULSE RESPONSE

CROSS-REFERENCE TO RELATED APPLICATIONS

This application claims the benefit of priority to U.S. Provisional Patent Application No. 61/948,849 filed 6 Mar. 2014, which is hereby incorporated by reference in its entirety.

FIELD OF THE INVENTION

One or more implementations relate generally to audio signal processing, and more specifically to a signal processing model for creating a Head-Related Impulse Response (HRIR) for use in audio playback systems.

BACKGROUND OF THE INVENTION

Humans have only two ears, but can locate sounds in three dimensions. The brain, inner ear, and external ears work together to make inferences about audio source location. In order for a person to localize sound in three dimensions, the sound must perceptually arrive from a specific azimuth (θ), elevation (φ), and range (r). Humans estimate the source location by taking cues derived from one ear and by comparing cues received at both ears to derive difference cues based on both time of arrival differences and intensity differences. The primary cues for localizing sounds in the horizontal plane (azimuth) are binaural and based on the interaural level difference (ILD) and interaural time difference (ITD). Cues for localizing sound in the vertical plane (elevation) appear to be primarily monaural, although research has shown that elevation information can be recovered from ILD alone. The cues for range are generally the least understood, and are typically associated with room reverberation, but in the near-field there is a pronounced increase in ILD as a source comes in close to the head from approximately a meter away.

It is well known that the physical effects of the diffraction of sound waves by the human torso, shoulders, head and pinnae modify the spectrum of the sound that reaches the tympanic membrane. These changes are captured by the Head-Related Transfer Function (HRTF), which not only varies in a complex way with azimuth, elevation, range, and frequency, but also varies significantly from person to person. An HRTF is a response that characterizes how an ear receives a sound from a point in space, and a pair of these functions can be used to synthesize a binaural sound that emanates from a source location. The time-domain representation of the HRTF is known as the Head-Related Impulse Response (HRIR), and contains both amplitude and timing information that may be hidden in typical magnitude plots of the HRTF. The effects of the pinna are sometimes isolated and referred to as the Pinna-Related Transfer Function (PRTF).

HRTFs are used in certain audio products to reproduce surround sound from stereo headphones; similarly HRTF processing has been included in computer software to simulate surround sound playback from loudspeakers. To facilitate such audio processing, efforts have been made to replace measured HRTFs with certain computational models. Azimuth effects can be produced merely by introducing the proper ITD and ILD. Introducing notches into the monaural spectrum can be used to create elevation effects. More sophisticated models provide head, torso and pinna cues.

Such prior efforts, however, are not necessarily optimum for reproducing newer generation audio content based on advanced spatial cues. The spatial presentation of sound utilizes audio objects, which are audio signals with associated parametric source descriptions of apparent source position (e.g., 3D coordinates), apparent source width, and other parameters. New professional and consumer-level cinema systems (such as the Dolby® Atmos™ system) have been developed to further the concept of hybrid audio authoring, which is a distribution and playback format that includes both audio beds (channels) and audio objects. Audio beds refer to audio channels that are meant to be reproduced in predefined, fixed speaker locations while audio objects refer to individual audio elements that may exist for a defined duration in time but also have spatial information describing the position, trajectory movement, velocity, and size (as examples) of each object. Thus, new spatial audio (also referred to as "adaptive audio") formats comprise a mix of audio objects and traditional channel-based speaker feeds (beds) along with positional metadata for the audio objects.

Virtual rendering of spatial audio over a pair of speakers commonly involves the creation of a stereo binaural signal that represents the desired sound arriving at the listener's left and right ears and is synthesized to simulate a particular audio scene in three-dimensional (3D) space, containing possibly a multitude of sources at different locations. For playback through headphones rather than speakers, binaural processing or rendering can be defined as a set of signal processing operations aimed at reproducing the intended 3D location of a sound source over headphones by emulating the natural spatial listening cues of human subjects. Typical core components of a binaural renderer are head-related filtering to reproduce direction dependent cues as well as distance cues processing, which may involve modeling the influence of a real or virtual listening room or environment. In the consumer realm, audio content is increasingly being played back through small mobile devices (e.g., mp3 players, iPods, smartphones, etc.) and listened to through headphones or earbuds. Such systems are usually lightweight, compact, and low-powered and do not possess sufficient processing power to run full HRTF simulation software. Moreover, the sound field provided by headphones and similar close-coupled transducers can severely limit the ability to provide spatial cues for expansive audio content, such as may be produced by movies or computer games.

What is needed is a system that is able to provide spatial audio over headphones and other playback methods in consumer devices, such as low-power consumer mobile devices.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are described for systems and methods of virtual rendering object-based audio content and improved spatial reproduction in portable, low-powered consumer devices, and headphone-based playback systems. Embodiments include a signal-processing model for creating a Head-Related Impulse Response (HRIR) from any given azimuth, elevation, range (distance) and sample rate (frequency). A structural HRIR model that breaks down the various physical parameters of the body into components allows a more intuitive "block diagram" approach to modeling. Consequently, the components of the model have a direct correspondence with anthropomorphic features, such as the shoulders, head and pinnae. Additionally, each component in the model corresponds to a particular feature that can be found in measured head related impulse responses.

Embodiments are generally directed to a method for creating a head-related impulse response (HRIR) for use in rendering audio for playback through headphones by receiving location parameters for a sound including azimuth, elevation, and range relative to the center of the head, applying a spherical head model to the azimuth, elevation, and range input parameters to generate binaural HRIR values, computing a pinna model using the azimuth and elevation parameters to apply to the binaural HRIR values to pinna modeled HRIR values, computing a torso model using the azimuth and elevation parameters to apply to the pinna modeled HRIR values to generate pinna and torso modeled HRIR values, and computing a near-field model using the azimuth and range parameters to apply to the pinna and torso modeled HRIR values to generate pinna, torso and near-field modeled HRIR values. The method may further comprise performing a timbre preserving equalization process on the pinna, torso and near-field modeled HRIR values to generate an output set of binaural HRIR values. The method further comprises utilizing in the spherical head model a set of linear filters to approximate interaural time difference (ITD) cues for the azimuth and elevation, and applying a filter to the ITD cues to approximate interaural level difference (ILD) cues for the azimuth and elevation.

In an embodiment, computing the near-field model further comprises fitting a polynomial to express the ILD cues as a function of frequency for the range and azimuth, calculating a magnitude response difference between near ear and far ear relative to a distance defined by a near-field range, and applying the magnitude response difference to a far field head related transfer function to obtain corrected ILD cues for the near-field range. The near-field range typically comprises a distance of one meter or less from at least one of the near ear or far ear, and the method may further comprise estimating one polynomial function each for the near ear and the far ear. The method further comprises compensating for interaural asymmetry by computing differences between ipsilateral and contralateral responses for the near ear and the far ear and applying a finite impulse response filter function to the differences as a function of the azimuth over a range of elevations.

In an embodiment, computing the torso model comprises computing a single direction of sound representing acoustic scatter off of the torso and directed up to the ear using a reflection vector comprising direction, level, and time delay parameters. The method further comprises deriving a torso reflection signal using the direction, level, and time delay parameters using a filter that models the head and torso as simple spheres with the torso of a radius approximately twice the radius of the head, and applying a shoulder reflection post-process including a low-pass filter to limit frequency response and decorrelate a torso impulse response for a defined range of elevations.

In an embodiment, computing the pinna model comprises determining a pinna resonance by examining a single cone of confusion for the azimuth and averaging over all possible elevations, determining a pinna shadow by applying front/back difference filters to model acoustic attenuation incurred by the pinna, and determining a location of pinna notches by estimating a polynomial function of elevation values that specifies the location of a notch for a given azimuth.

Embodiments are further directed to a method for providing localization and externalization of sounds positioned being reproduced from outside of a listener's head by modeling the listener's head utilizing linear filters that provide relative time delays for interaural time difference (ITD) cues and interaural level difference (ILD) cues, modeling near-field effects of the sound by modeling the ILD cues as a function of distance and the ITD cues as a function of the listener's head size, modeling the listener's torso using a reflection vector that aggregates sound reflections off of the torso, and a time delay incurred by the torso reflection, and modeling the pinna using front/back filters to simulate pinna shadow effects and filter processes to simulate pinna resonance effects and pinna notch effects.

Embodiments are further directed to systems and articles of manufacture that perform or embody processing commands that perform or implement the above-described method acts.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION OF THE INVENTION

Systems and methods are described for generating a structural model of the head related impulse response and utilizing the model for virtual rendering of spatial audio content for playback over headphones, though applications are not so limited. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
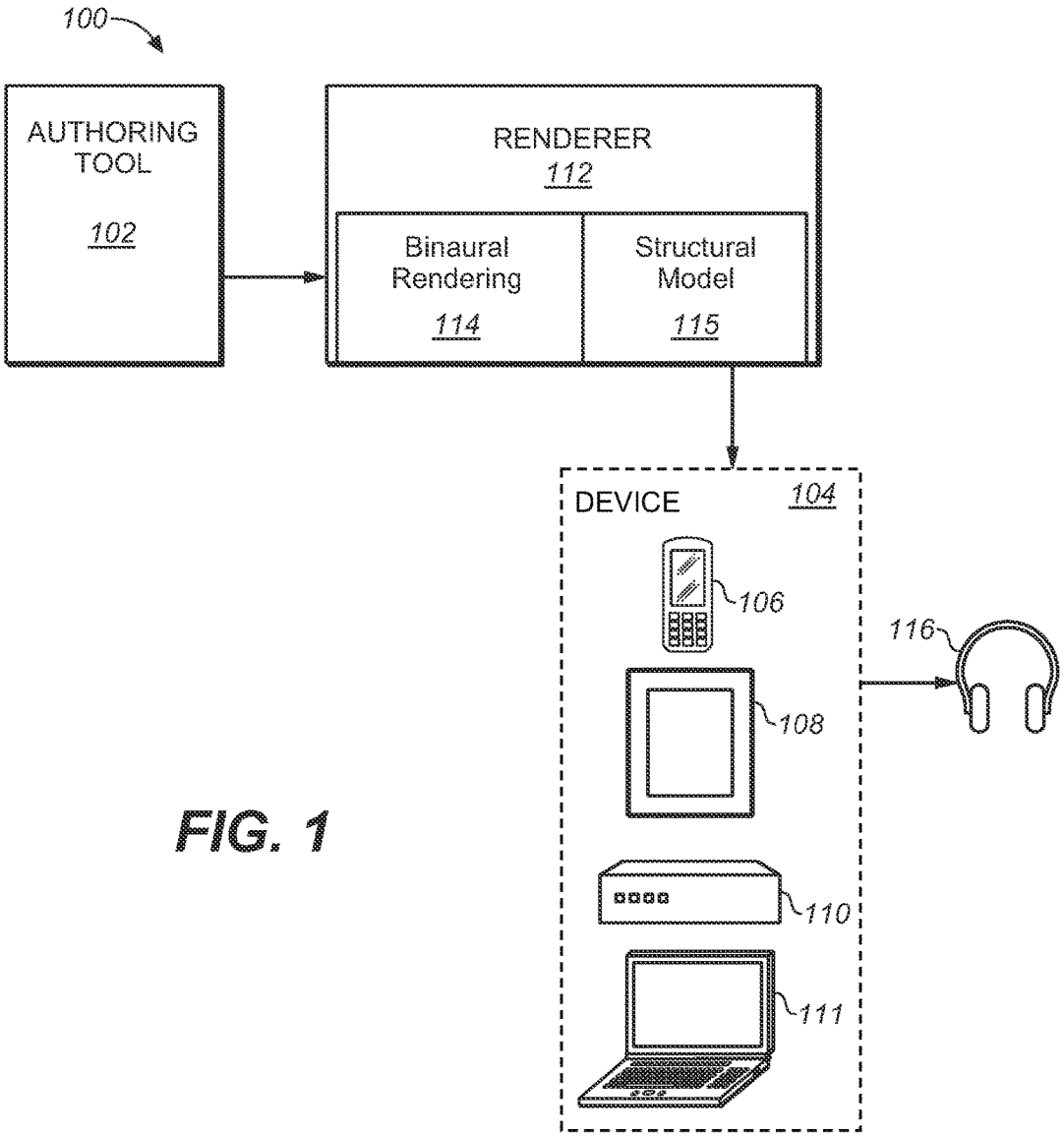
FIG. 1 illustrates a rendering and headphone playback system that incorporates an HRIR structural modeling component, under some embodiments.

Embodiments are directed to a structural HRIR model that can be used in an audio content production and playback system that optimizes the rendering and playback of object and/or channel-based audio over headphones. FIG. 1 illustrates an overall system that incorporates embodiments of a content creation, rendering and playback system, under some embodiments. As shown in system 100, an authoring tool 102 is used by a creator to generate audio content for playback through one or more devices 104 for a user to listen to through headphones 116. The device 104 is generally a portable audio or music player or small computer or mobile telecommunication device that runs applications that allow for the playback of audio content. Such a device may be a mobile phone or audio (e.g., MP3) player 106, a tablet computer (e.g., Apple iPad or similar device) 108, music console 110, a notebook computer 111, or any similar audio playback device. The audio may comprise music, dialog, effects, or any digital audio that may be desired to be listened to over headphones 116, and such audio may be streamed wirelessly from a content source, played back locally from storage media (e.g., disk, flash drive, etc.), or generated locally. In the following description, the term "headphone" usually refers specifically to a close-coupled playback device worn by the user directly over his or her ears or in-ear listening devices; it may also refer generally to at least some of the processing performed to render signals intended for playback on headphones as an alternative to the terms "headphone processing" or "headphone rendering." Although embodiments are described with respect to playback over headphones, it should be noted that playback through other transducer systems is also possible, such as small monitor speakers, desktop/bookshelf speakers, floor standing speakers, and so on. Such other playback systems may benefit from the use of cross talk cancellation or other similar processing to be optimized for rendering using the models described herein.

In an embodiment, the audio processed by the system may comprise channel-based audio, object-based audio or object and channel-based audio (e.g., hybrid or adaptive audio). The audio comprises or is associated with metadata that dictates how the audio is rendered for playback on specific endpoint devices and listening environments. Channel-based audio generally refers to an audio signal plus metadata in which the position is coded as a channel identifier, where the audio is formatted for playback through a pre-defined set of speaker zones with associated nominal surround-sound locations, e.g., 5.1, 7.1, and so on; and object-based means one or more audio channels with a parametric source description, such as apparent source position (e.g., 3D coordinates), apparent source width, etc. The term "adaptive audio" may be used to mean channel-based and/or object-based audio signals plus metadata that renders the audio signals based on the playback environment using an audio stream plus metadata in which the position is coded as a 3D position in space. In general, the listening environment may be any open, partially enclosed, or fully enclosed area, such as a room, but embodiments described herein are generally directed to playback through headphones or other close proximity endpoint devices. Audio objects can be considered as groups of sound elements that may be perceived to emanate from a particular physical location or locations in the environment, and such objects can be static or dynamic. The audio objects are controlled by metadata, which among other things, details the position of the sound at a given point in time, and upon playback they are rendered according to the positional metadata. In a hybrid audio system, channel-based content (e.g., 'beds') may be processed in addition to audio objects, where beds are effectively channel-based sub-mixes or stems. These can be delivered for final playback (rendering) and can be created in different channel-based configurations such as 5.1, 7.1.

As shown in FIG. 1, the headphone 116 utilized by the user may be embodied in any appropriate close-ear device, such as open or closed headphones, over-ear or in-ear headphones, earbuds, earpads, noise-canceling, isolation, or other type of headphone device. Such headphones may be wired or wireless with regard to its connection to the sound source or device 104. The headphone 116 may be a passive device that has non-powered transducers that simply recreate the audio signal produced by the renderer and played through device, or it may be a powered device that has powered transducers and/or an included amplifier stage. It may also be an enabled headphone 116 that includes sensors and other components (powered or non-powered) that provide certain operational parameters back to the renderer for further processing and optimization of the audio content.

In an embodiment, the audio content from authoring tool 102 includes stereo or channel based audio (e.g., 5.1 or 7.1 surround sound) in addition to object-based audio. For the embodiment of FIG. 1, a renderer 112 receives the audio content from the authoring tool and provides certain functions that optimize the audio content for playback through device 104 and headphones 116. In an embodiment, the renderer 112 may include certain processing stages that segment the audio (e.g., based on content or frequency/dynamic characteristics), and performs downmixing, equalization, gain/loudness/dynamic range control, and other functions prior to transmission of the audio signal to the device 104. The renderer 112 also includes a binaural rendering stage 114 that combines and processes the metadata associated with the channel and object components of the audio and generates a binaural stereo or multi-channel audio output with binaural stereo and additional low frequency outputs; It should be noted that while the renderer will likely generate two-channel signals in most cases, it could be configured to provide more than two channels of input to specific enabled headphones, for instance to deliver separate bass channels (similar to LFE 0.1 channel in traditional surround sound).

For the embodiment of FIG. 1, the rendering stage 114 also includes a structural modeling component 115. This component provides a signal processing model used by the renderer to create a head-related impulse response (HRIR) from any given azimuth, elevation, range (distance) and sample rate (frequency). It breaks down the various physical parameters of the physical body into components that allow a more intuitive "block diagram" approach to modeling. The components of the model have a direct correspondence with anthropomorphic features, such as the shoulders, head and pinnae. Additionally, each component in the model corresponds to a particular feature that can be found in measured HRIRs.

Various platforms could be used to host the system, from encoder-based processors that are applied prior to encoding and distribution, to low-power consumer mobile devices, as shown in FIG. 1. The structural modeling component 115 of system 100 provides spatial audio over headphones and other playback methods in consumer devices, such as low-power consumer mobile devices 104; provides optimized spatial localization, including localization of sounds or channels positioned above the horizontal plane; provides optimized externalization or the perception of sound objects being reproduced from outside the head; and provides preservation of timbre, relative to stereo downmix headphone listening. In general, preservation of timbre could reduce the spatial localization and externalization. For instance, typical listening over loudspeakers is naturally lowpassed due to acoustic head-related diffraction effects, and if the system removes this natural lowpass filtering, there could be some loss in performance of the other two objectives. However, it is expected that this loss in spatial and externalization performance is minimal, and outweighed by the need to preserve timbre relative to stereo headphone playback.

It should be noted that the components of FIG. 1 generally represent the main functional blocks of the audio generation, rendering, and playback systems, and that certain functions may be incorporated as part of one or more other components. For example, one or more portions of the renderer 112 may be incorporated in part or in whole in the device 104. In this case, the audio player or tablet (or other device) may include a renderer component integrated within the device. Similarly, the enabled headphone 116 may include at least some functions associated with the playback device and/or renderer. In such a case, a fully integrated headphone may include an integrated playback device (e.g., built-in content decoder, e.g. MP3 player) as well as an integrated rendering component. Additionally, one or more components of the renderer 112, such as the structural model 115 may be implemented at least in part in the authoring tool, or as part of a separate pre-processing component.

HRIR Model

In spatial audio reproduction, certain sound source cues are virtualized. For example, sounds intended to be heard from behind the listeners may be generated by speakers physically located behind them, and as such, all of the listeners perceive these sounds as coming from behind. With virtual spatial rendering over headphones, on the other hand, perception of audio from behind is controlled by head related transfer functions that are used to generate the binaural signal. In an embodiment, the structural modeling and headphone processing system 100 may include certain HRTF/HRIR modeling mechanisms. The foundation of such a system generally builds upon the structural model of the head and torso. This approach allows algorithms to be built upon the core model in a modular approach. In this algorithm, the modular algorithms are referred to as 'tools.' In addition to providing ITD and ILD cues, the model approach provides a point of reference with respect to the position of the ears on the head, and more broadly to the tools that are built upon the model. The system could be tuned or modified according to anthropometric features of the user. Other benefits of the modular approach allow for accentuating certain features in order to amplify specific spatial cues. For instance, certain cues could be exaggerated beyond what an acoustic binaural filter would impart to an individual.

Figure 2A:
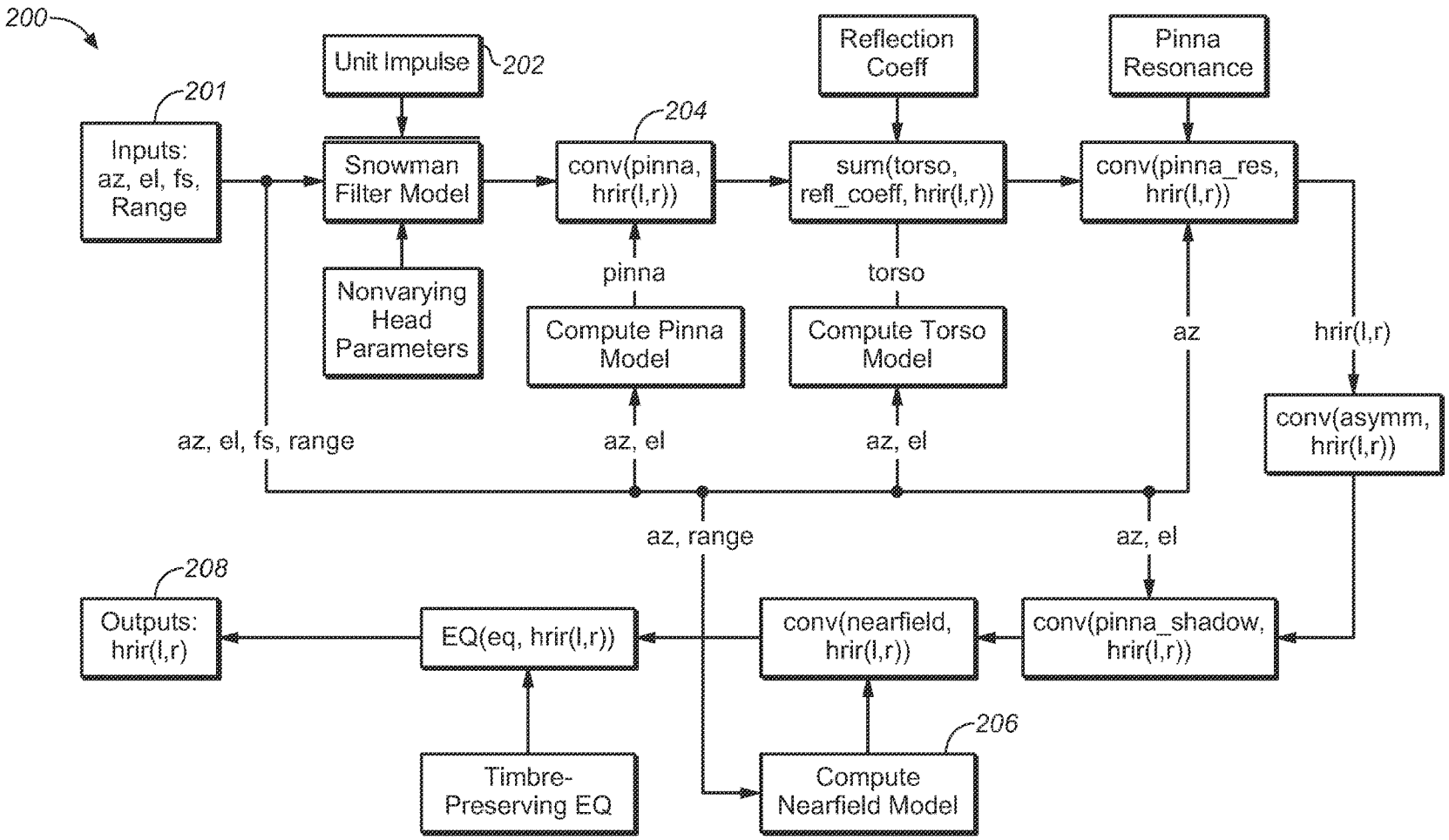
FIG. 2A is a system diagram showing the different tools used in an HRTF/HRIR modeling system used in a headphone rendering system, under an embodiment.

FIG. 2A is a system diagram showing the different tools used in an HRTF/HRIR modeling system used in a headphone rendering system, under an embodiment. As shown in FIG. 2, certain inputs including azimuth, elevation, frequency (sample rate), and range are input to modeling stage 204, after at least some input components are filtered 202. In an embodiment, filter stage 202 may comprise a spherical head model that consists of a spherical head on top of a spherical body and accounts for the contributions of the torso as well as the head to the HRTF. Modeling stage 204 computes the pinna and torso models and the left and right (l, r) components are post-processed 206 for final output 208.

Figure 2B:
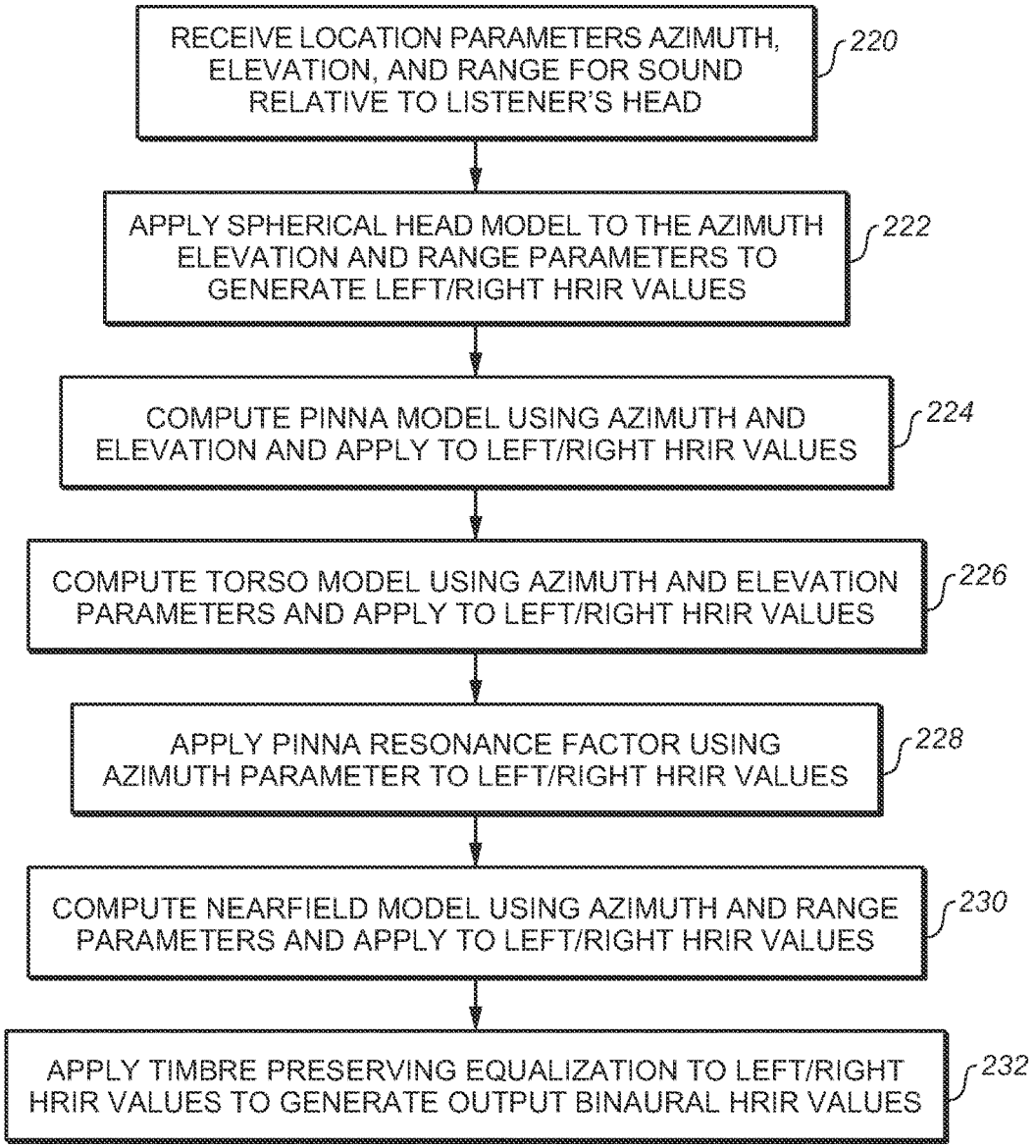
FIG. 2B is a flowchart illustrating a method of creating a structural HRIR model using the system of FIG. 2A, under an embodiment.

FIG. 2B is a flowchart illustrating a method of creating a structural HRIR model using the system of FIG. 2A, under an embodiment. The process begins by the system receiving location parameters of azimuth, elevation and range for a sound relative to a listener's head, 220. It then applies a spherical head model to the azimuth, elevation, and range input parameters to generate binaural (left/right) HRIR values, 222. The system next computes a pinna model using the azimuth and elevation parameters to apply to the binaural HRIR values to generate pinna modeled HRIR values, 224. It then computes a torso model using the azimuth and elevation parameters to apply to the pinna modeled HRIR values to generate pinna and torso modeled HRIR values, 226. Pinna resonance factors may be applied to the binaural HRIR values through a process step that utilizes the azimuth parameter, 228. The process then computes a near-field model using the azimuth and range parameters to apply to the pinna and torso modeled HRIR values to generate pinna, torso and near-field modeled HRIR values using the asymmetry and front/back pinna shadowing filters as shown in section 206 of FIG. 2A, 230. A timbre preserving equalization process may then be performed on the pinna, torso and near-field modeled HRIR values to generate an output set of binaural HRIR values, 232.

In an embodiment, the pinna, torso and near-field modeled HRIR values comprise an HRIR model that represents a head related transfer function (HRTF) of a desired position of one or more object signals in three-dimensional space relative to the listener. The modeled sound may be rendered as audio comprising channel-based audio and object-based audio including spatial cues for reproducing an intended location of the sound. The binaural HRIR values may be encoded as playback metadata that is generated by a rendering component, and the playback metadata may modify content dependent metadata generated by an authoring tool operated by a content creator, wherein the content dependent metadata dictates the rendering of an audio signal containing audio channels and audio objects. The content dependent metadata may be configured to control a plurality of channel and object characteristics including: position, size, gain adjustment, elevation emphasis, stereo/full toggling, 3D scaling factors, spatial and timbre properties, and content dependent settings. The structural HRIR model in conjunction with the metadata delivery system facilitates rendering of audio and preservation of spatial cues for audio played through a portable device for playback over headphones.

The interaural polar coordinate system used in the model 115 requires special mention. In this system, surfaces of constant azimuth are cones of constant interaural time difference. It should also be noted that it is elevation, not azimuth that distinguishes front from back. This results in a "cone of confusion" for any given azimuth, where ITD and ILD are only weakly changing and instead spectral cues (such as pinna notches) tend to dominate on the outer perimeter of the cone. As a result, the range of azimuths may be restricted from negative 90 degrees (left) to positive 90 degrees (right). For practical considerations, the system may be configured to restrict the range of elevation from directly above the head (positive 90 degrees) to 45 degrees below the head (minus 45 degrees in front to positive 225 degrees in back). It should also be noted that when at the extreme azimuths, a cone of confusion is a single point, meaning all elevations are the same. Restricting the range of azimuth angles may be required in certain implementation or application contexts, however it should be noted that such angles are not always strictly restricted and may utilize the full spherical range.

Figure 3:
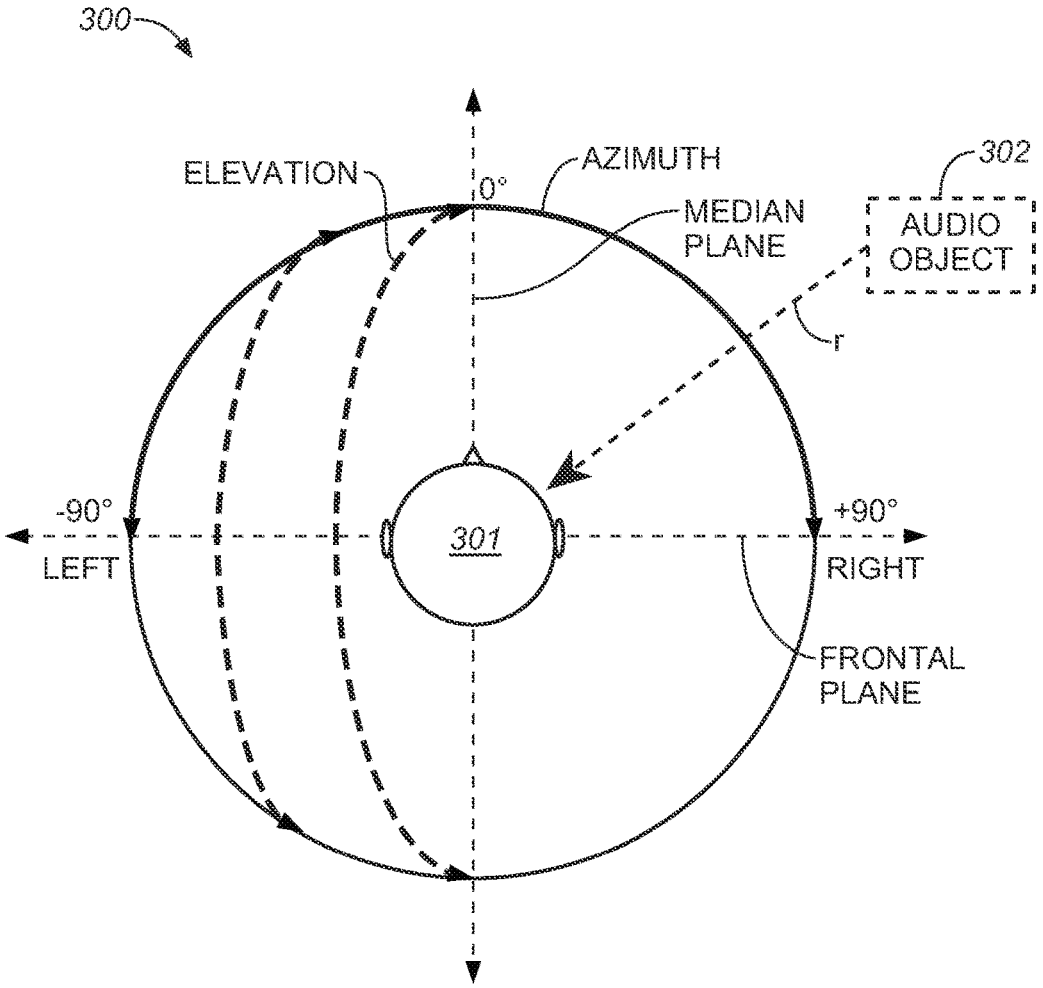
FIG. 3 is a diagram that illustrates the coordinate system used in a structural HRIR model, under an embodiment.

FIG. 3 is a diagram that illustrates the coordinate system used in a structural HRIR model, under an embodiment. Diagram 300 illustrates an interaural polar coordinate system relative to a person 301 comprising a frontal plane defined by an axis going through the ears of the person and a median plane projecting front to back of the person. The location of an audio object perceptively located at a range r from the person is described in terms of azimuth (az or θ), elevation (el or φ), and range (r). Though embodiments are described with respect to one or more particular coordinate systems, it should be noted that embodiments of the structural HRIR model can be configured to work in virtually any 3D space regardless of the coordinate system used.

Figure 4:
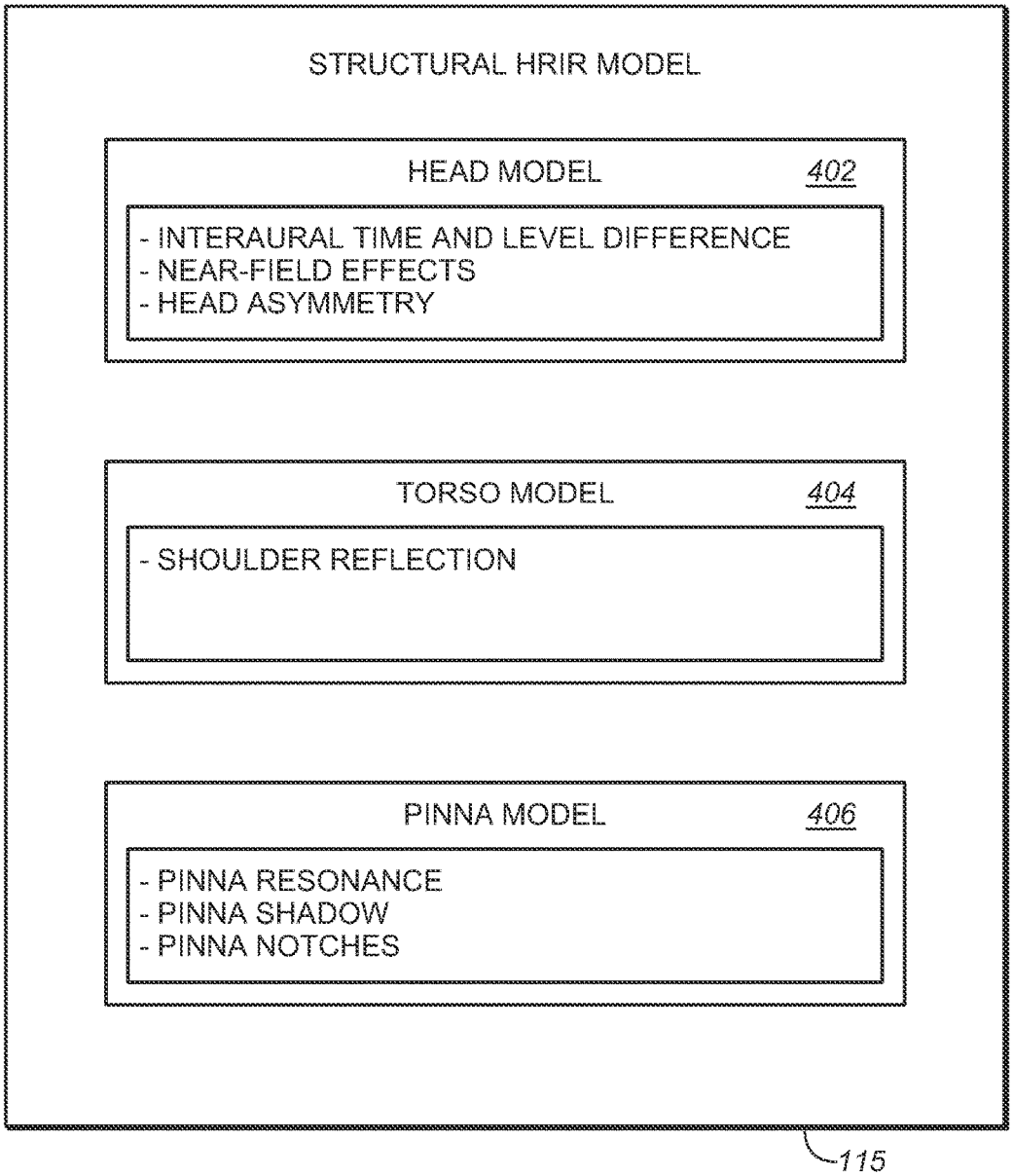
FIG. 4 illustrates the basic components of the structural model under an embodiment, including a head model, a torso model, and a pinna model.

As stated above, the structural HRIR model 115 breaks down the various physical parameters of the body into components that facilitate a building block approach to modeling for creating an HRIR from any given azimuth, elevation, range, and frequency. FIG. 4 illustrates the basic components of the structural model 115 as comprising a head model 402, a torso model 404, and a pinna model 406.

Head Modeling

While it is theoretically possible to calculate an HRTF by solving the wave equation, subject to the boundary conditions presented by the torso, shoulders, head, pinnae, ear canal and ear drum, at present this is analytically beyond reach and computationally formidable. However, past researchers (e.g., Lord Rayleigh) have obtained a simple and very useful low-frequency approximation by deriving the exact solution for the diffraction of a plane wave by a rigid sphere. The resulting transfer function gives the ratio of the pressure at the surface of the sphere to the free-field pressure. This sphere forms the basis for the head model 402 used in the structural HRIR model, under an embodiment.

The difference between the time that a wave arrives at the observation point and the time it would arrive at the center of the sphere in free space is approximated by a frequency-independent formula (see, e.g., Woodworth and Schlosberg). From this approximation, the ITD for a given azimuth and elevation can be calculated using the formula (Eq. 1) below.

$$ITD=(a/c)\cdot(\arcsin(\cos\varphi\cdot\sin\theta)+\cos\varphi\cdot\sin\theta)\,0\le\theta\le\pi/2,\quad 0\le\varphi\le\pi/2 \qquad \text{Eq. 1}$$

where, θ=azimuth angle, φ=elevation angle, a=head radius, c=speed of sound

Note that the angle here is expressed in radians (rather than degrees) for the ITD calculation. It should also be noted that for θ 0 radians (0°) is straight ahead, π/2 (90°) is directly right; and for φ, 0 radians (0°) is straight ahead, π/2 (90°) is directly overhead. For φ=0 (horizontal plane), this equation reduces to:

$$ITD=(a/c)\cdot(\theta+\sin\theta)\,0\le\theta\le\pi/2 \qquad \text{Eq. 2}$$

The HRIR can be modeled by simple linear filters that provide the relative time delays. This will provide frequency-independent ITD cues, and by adding a minimum-phase filter to account for the magnitude response (or head-shadow) we can approximate the ILD cue. The ILD filter can additionally provide the frequency-dependent delay observed. By cascading a delay element (ITD) with the single-pole, single-zero head-shadow filter (ILD), the analysis yields an approximate signal-processing implementation of Rayleigh's solution for the sphere.

For two ears (near and far), it can be shown that two filters (an HRIR model pair) can be derived that approximate ILD cues as follows (where β=2c/a):

$$H_{ipsi}(z)=\frac{b_{i0}+b_{i1}z^{-1}}{a_{i0}+a_{i1}z^{-1}}\quad\text{(ispilateral, near ear)} \qquad \text{Eq. 3}$$

$$H_{contra}(z)=\frac{b_{c0}+b_{c1}z^{-1}}{a_{c0}+a_{c1}z^{-1}}\quad\text{\{contralateral, far ear)} \qquad \text{Eq. 4}$$

Figure 5:
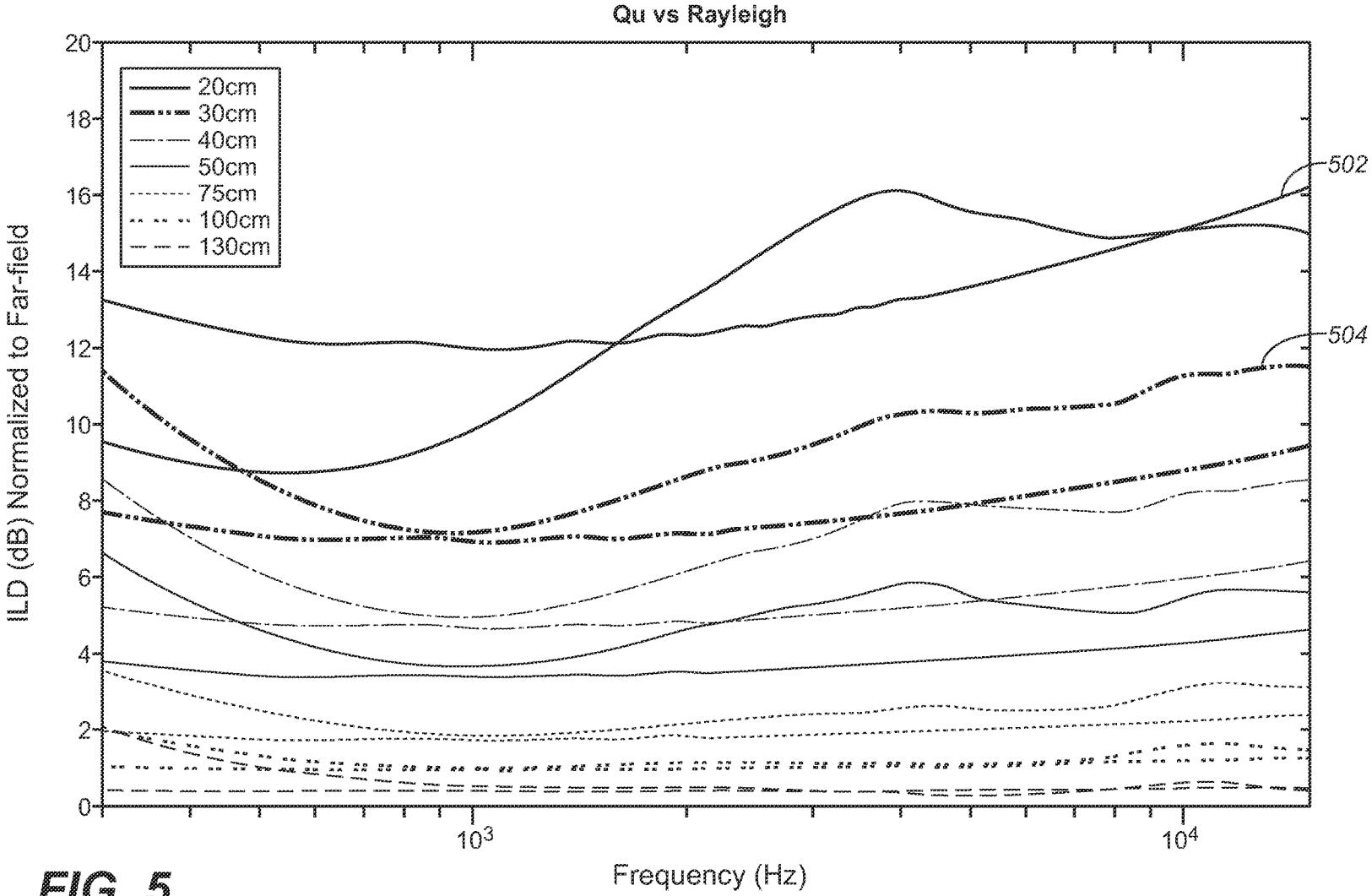
FIG. 5 is a diagram that illustrates how ILD varies as a function of distance at a given azimuth using Rayleigh's spherical head model.

$a_o=a_{i0}=a_{co}=\beta+2$
$a_1=a_{i1}=a_{c1}=\beta-2$
$b_{i0}=\beta+2\alpha_i(\theta)$
$b_{i1}=\beta-2\alpha_i(\theta)$
$b_{c0}=\beta+2\alpha_c(\theta)$
$b_{c1}=\beta-2\alpha_c(\theta)$
$\alpha_i(\theta)=1+\cos(\theta-90°)=1+\sin(\theta)$
$\alpha_c(\theta)=1+\cos(\theta+90°)=1-\sin(\theta)$ With regard to near-field effects, typically HRTFs are measured at a distance of greater than 1 m (one meter). At that distance (which is typically considered as "far-field"), the angle between the sound source and the listener's left ear ($\theta_L$) and the angle between the sound source and the listener's right ear ($\theta_R$) are similar (i.e., $abs(\theta_L-\theta_R)<2$ degrees). However, when the distance between the sound source and the listener is less than 1 m, or more typically ~0.2 m, the discrepancy between $\theta_L$ and $\theta_R$ can become as high as 16 degrees. It has been found that modeling this parallax effect does not sufficiently approximate the near-field effects. So instead, the method models the frequency dependent ILD directly as a function of distance. As the sound source nears the listener, the Interaural Level Difference (ILD) at higher frequencies is much more pronounced than at lower frequencies due to the increased head shadow effect. FIG. 5 is a diagram that illustrates how ILD varies as a function of distance at a given azimuth using a known spherical head model (dotted lines 502) and compares it with certain database measurements on a dummy head at corresponding distances (solid lines 504).

Figure 6:
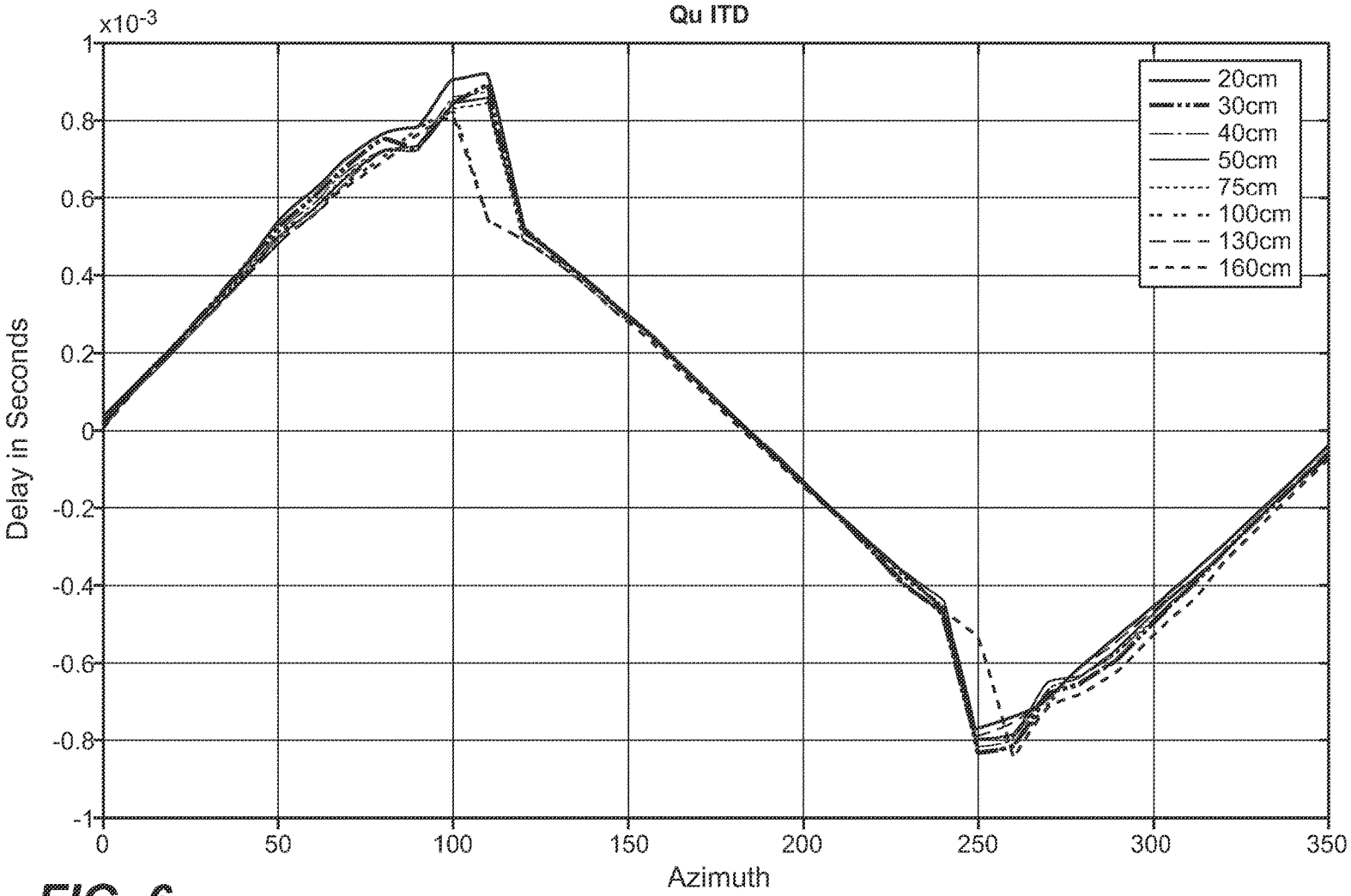
FIG. 6 is a diagram illustrating ITD as a function of distance of the sound source to the listener.

FIG. 6 is a diagram illustrating ITD as a function of distance of the sound source to the listener. In contrast with ILD, as evident from FIG. 6, ITD is not strongly dependent on distance, although ITD does generally exhibit a strong dependence on head size.

With regard to modeling near-field effects, there are three factors that affect ILD: frequency, distance of the sound source to the listener (range), and angle (azimuth) of the source to the listener. In order to model the near-field effect, the process fits a polynomial to capture the ILD as a function of frequency for a given distance and a given azimuth. The distance (range) values are allowed take on any value from a set of 16 distinct range values {0.2 m, 0.3 m, . . . 1.6 m}, and the azimuth values are allowed to take on any value from a set of 10 distinct values {0, 10, 20, . . . 90}. This yields a set of 16*10 (160) polynomials to capture the ILD as a function of frequency. Although a certain number of distinct range values have been described, other numbers of range values are also possible.

The process also models the proximity of the source to the ears since the HRTF is known to vary as a function of the proximity of the source relative to the ears. In an embodiment, this proximity is referred to as a range, where range=0 is a position collocated at the ear canal entrance. Consider the equation (Eq. 5) below that expresses ILD at frequency f, range 0.2 m and azimuth (az) in terms of magnitude response difference (in dB) between near-ear and far-ear:

$$ILD(f,0.2,az)=dB_i(f,0.2,az)-dB_c(f,0.2,az) \quad \text{Eq. 5}$$

Consider the same equation at far-field (1.6 m):

$$ILD(f,1.6,az)=dB_i(f,1.6,az)-dB_c(f,1.6,az) \quad \text{Eq. 6}$$

Subtracting Eq. 6 from Eq. 5, gives the correction needed to be applied to far-field HRTF to get the correct ILD at a near-field range (in this case 0.2 m).

$$ILDrel(f,0.2,az)=dBrel_i(f,1.6,az)-dBrel_c(f,1.6,az)$$

In the above equations:

$$dBrel_i(f,1.6,az)=dB_i(f,0.2,az)-dB_i(f,1.6,az)$$

$$dBrel_c(f,1.6,az)=dB_c(f,0.2,az)-dB_c \quad (f,1.6,az)$$

Figure 7:
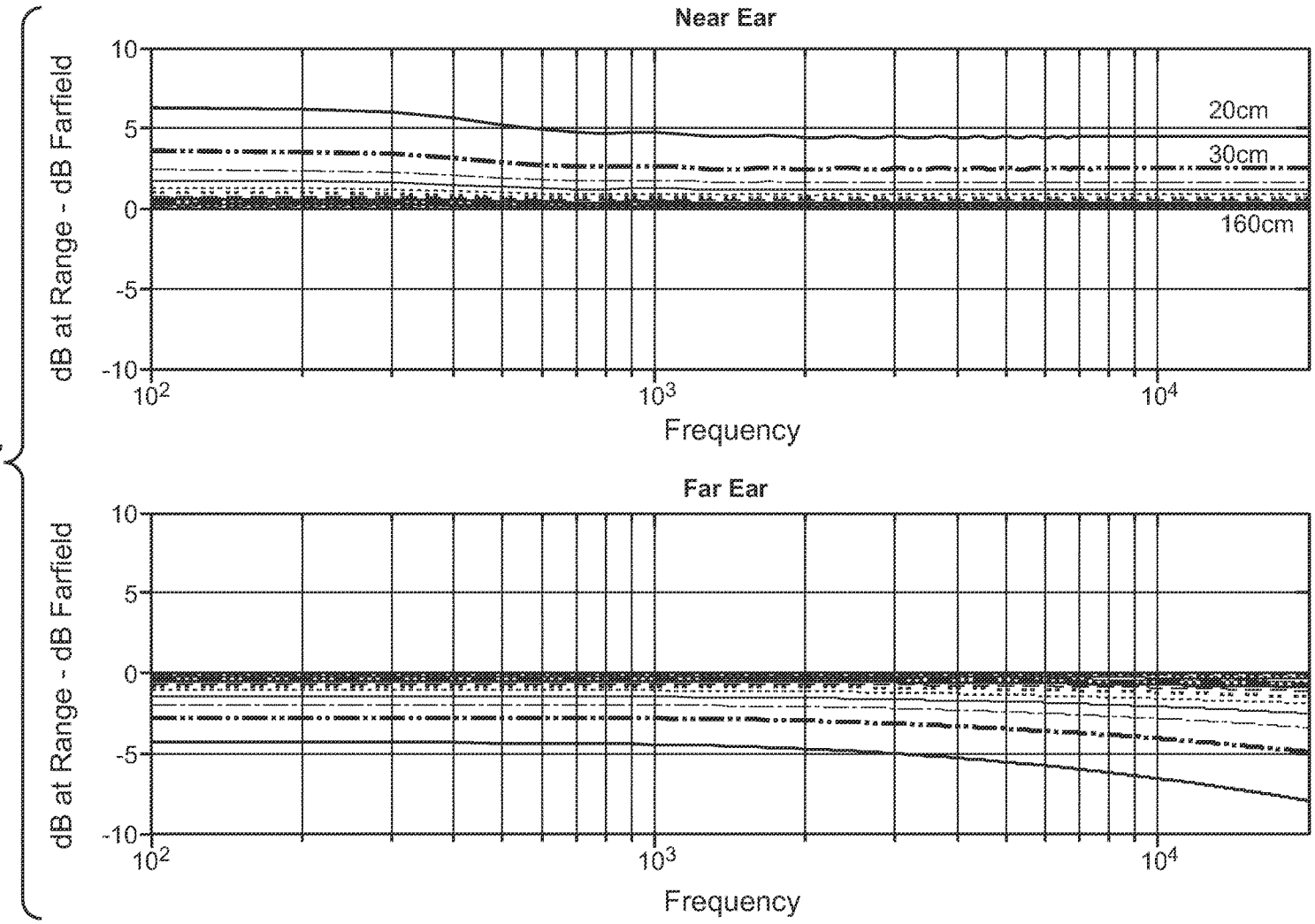
FIG. 7 is a diagram that shows certain near ear and far ear intensity values at various ranges for a first azimuth value.
Figure 8:
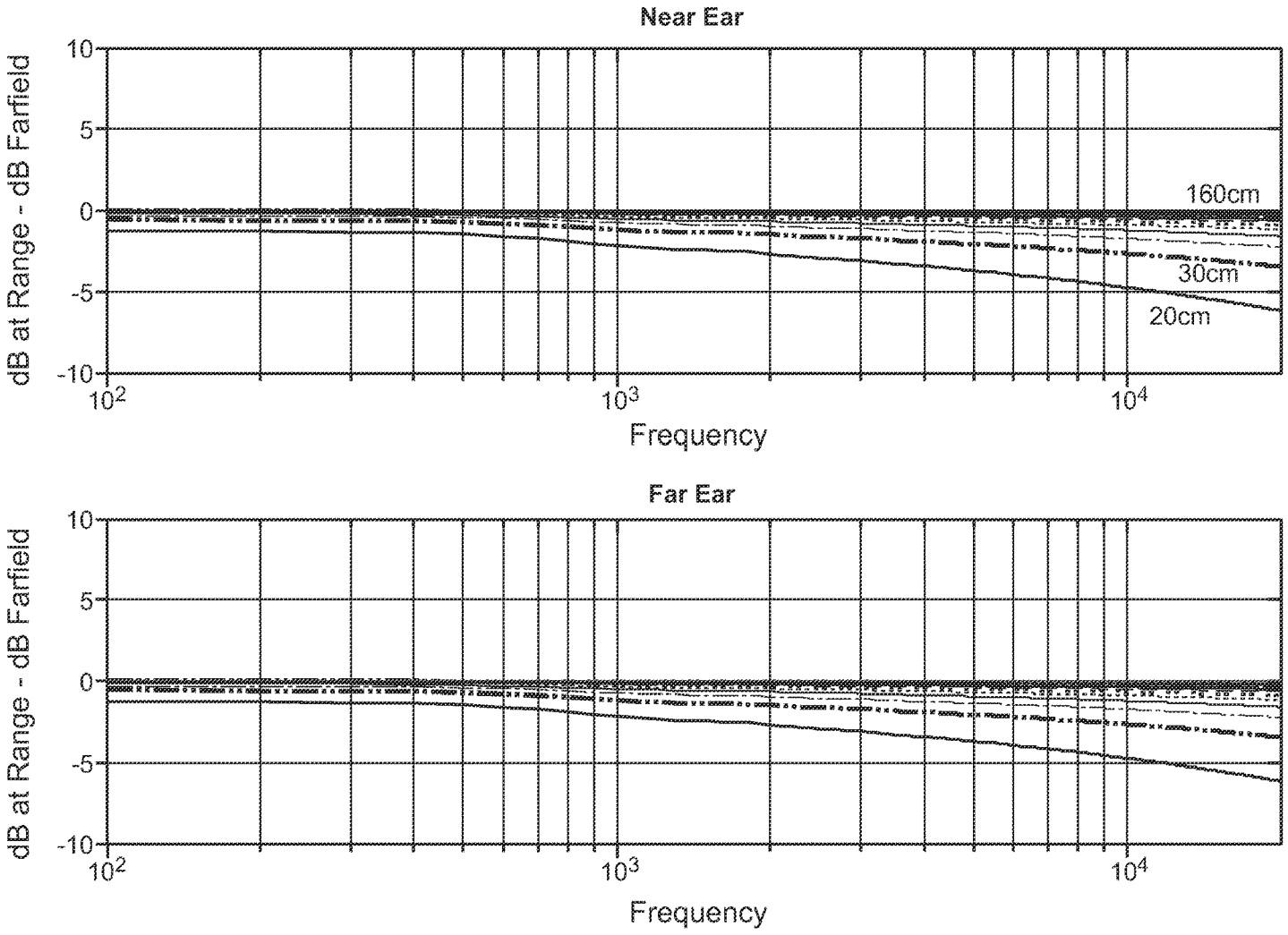
FIG. 8 is a diagram that shows certain near ear and far ear intensity values at various ranges for a second azimuth value.

FIG. 7 is a diagram that shows "$dBrel_i$" and "$dBrel_c$" at various values of range (0.2, 0.3 . . . 1.6) at azimuth value=90 degrees (right side of the listener). Similarly, FIG. 8 shows "$dBrel_i$" and "$dBrel_c$" values at azimuth=0 (median plane). Note that near ear and far ear values look similar on the median plane as a function of distance.

Each dB curve (e.g., in FIG. 7 or FIG. 8) corresponding to a range at a given azimuth value (az) can be represented using a set of pairs $\{(f_1, r_{1,1\ldots N}, d_{1,1\ldots N}), (f_2, r_{2,1,\ldots N}, d_{2,1\ldots N}), \ldots (f_K, r_{K,1\ldots N}, d_{K,1\ldots N})\}$. Here $(f_k, r_{k,1\ldots N}, d_{k,1\ldots N})$ represents that the frequency varies as $f_i$ up to a maximum frequency index of K, and for each frequency value, the range r varies over N. Finally d is the measured dB level at that frequency and range. This is done for a constant azimuth value and N is the number of discrete range values. The next step is to form an array of frequency/range values (fr) and corresponding dB values d, where fr is a matrix that has the following NK elements: $\{(f_1, r_{1,1\ldots N}), (f_2, r_{2,1\ldots N}), \ldots (f_K r_{K,1\ldots N})\}$. Similarly, the vector d has the following elements: $(d_{1,1\ldots N}, d_{2,1\ldots N}, \ldots d_{K,1\ldots N})$. We seek a function $\varphi(fr_{i,k})$ that maps a given range/frequency value $fr_{i,k}$ to a dB value. If $\varphi(fr)$ is a $P^{th}$ order polynomial (i.e., $\varphi(fr)=m_P fr^P+m_{P-1}fr^{P-1}+\ldots m_1 fr+m_0$). The process yields a matrix equation as: F m=d, where F is a 3-dimensional matrix of dimension P+1 by N by K. Column 'i' of matrix F is $fr^{(P-(i-1))}$; m is vector of P+1 parameters $(m_P, m_{P-1}, \ldots m_0)$(that we seek to estimate). The least squares solution to the parameter vector m is $(F^TF)^{-1}(F^Td)$. This calculation is repeated over all discrete azimuth values. A preferred embodiment thus computes the surface optimization over the dimensions frequency and range, but other optimizations could be computed, such as a least squares optimization that is computed over frequency and azimuth, or frequency, azimuth and range all together.

Given the polynomial representations of the level based on frequency and range, the level adjustment to the HRTFs can be applied for the desired azimuth, elevation and range. This will result in the desired ILD in the above equation. For azimuth values between the discrete values computed above, the values of dB can be computed by interpolating the m coefficients to arrive at the interpolated azimuth. This provides a very low-memory means for computing the near-field effect.

The previous section described a method to estimate a polynomial function of frequency values that specifies the db_value differences relative to far-field for a given azimuth and a given range. In an embodiment, the process estimates one polynomial function for the near-ear and another for the far-ear. When it applies these corrections (db_value differences relative to far-field) as a filter to far-field near-ear HRTFs and far-ear HRTFs, the process yields the desired ILD at a particular range value.

As mentioned earlier, if the azimuth values are allowed to take on ten distinct values {0, 10, . . . 90} and range takes on 16 distinct values {0.2, 0.3, . . . 1.6}, then there would be 16*10 different m vectors to predict the db_values for the near-ear. Similarly, there would be 160 different m vectors to predict db_values for the far-ear. In order to predict, the db_values at any arbitrary azimuth and range, a linear interpolation would be performed between the two predictions of the two nearest azimuth's models.

With regard to head asymmetry, it has been shown that interaural asymmetry plays a role in the perceived localization of objects, particularly in regards to elevation. In this case the asymmetry in question is across the median plane for equal but opposite (in sign) azimuth angles. Since the model is inherently symmetric, it makes sense to build a tool that introduces a degree of azimuthal asymmetry into the system. These differences are computed as follows for the ipsilateral sides, as shown in Eq. 7:

$$\left.\begin{aligned} HRTF_{i_diff}(L, az) &= \frac{HRTF_i(-az) - HRTF_i(az)}{2} \\ HRTF_{i_diff}(R, az) &= \frac{HRTF_i(az) - HRTF_i(-az)}{2} \end{aligned}\right\} \quad \text{Eq. 7}$$

$$0 > az > 90$$

Likewise, the contralateral sides are computed similarly in Eq. 8:

$$\left.\begin{aligned} HRTF_{C_diff}(L, az) &= \frac{HRTF_C(az) - HRTF_C(-az)}{2} \\ HRTF_{C_diff}(R, az) &= \frac{HRTF_C(-az) - HRTF_C(az)}{2} \end{aligned}\right\} \quad \text{Eq. 8}$$

$$0 > az > 90$$

Figure 9:
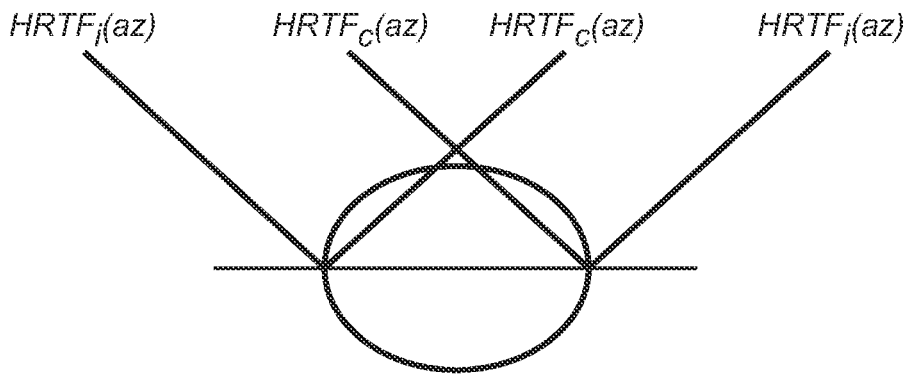
FIG. 9 is a top-down view showing angles of inclination for computing head asymmetry, under an embodiment.

Finally, since the effect of asymmetry is only relevant in terms of affecting perceptual cues near the median plane, we apply a window to $HRTF_{C_diff}(L,R)$ and $HRTF_{i_diff}(L,R)$ to limit the effect of the left/right difference filter to a range ±20 degrees from the median plane. FIG. 9 is a top-down view showing angles of inclination for computing head asymmetry, under an embodiment.

A minimum-phase FIR filter is computed for the response, where the response is a function of azimuth. This is also done for all elevations over the range of elevations from −45 degrees to +225 degrees behind the head. Since the HRTF responses are frequency-domain magnitude responses, the filters are computed according to:

$$BR_{i_diff,C_diff}(L,\text{az},\text{el},t)=w(t)FFT^{-1}[MINPH\{\text{HRTF}_{i_diff,C_diff}(L,\text{az},\text{el},f)\}]$$

$$BR_{i_diff,C_diff}(R,\text{az},\text{el},t)=w(t)FFT^{-1}[MINPH\{\text{HRTF}_{i_diff,C_diff}(R,\text{az},\text{el},f)\}] \quad \text{Eq. 9}$$

In the above equation, MINPH{ } is a function that takes as an argument a vector of real numbers that represent the magnitude of the frequency response, and returns a complex vector with a synthesized phase that guarantees a minimum-phase impulse response upon transformation to the time domain. $FFT^{-1}\{\ \}$, is the inverse FFT transform to generate the time domain FIR filters, while w is a windowing function to taper the response to zero towards the tail of the filter BR.

In general, there can be significant asymmetry as evidenced by a discontinuity at az=0 in certain difference plots for ITA datasets. Other subjects from the CIPIC database can be analyzed in this fashion, and it may be found that there is no overall trend. The cause of such asymmetries may be as much a factor of the position of the mannequin/subject relative to the microphone assembly when the HRTF measurements were made as it is a factor of true asymmetry between HRTFs for each ear. Thus the purpose of the generated BR filters is to impart a somewhat arbitrary synthetic left/right asymmetry.

Under one or more embodiments HRTF data can be derived or obtained from several sources. One such source is the CIPIC (Center for Image Processing and Integrated Computing) HRTF Database, which is a public-domain database of high-spatial-resolution HRTF measurements for 45 different subjects, including the KEMAR mannequin with both small and large pinnae. This database includes 2,500 measurements of head-related impulse responses for each subject. These "standard" measurements were recorded at 25 different interaural-polar azimuths and 50 different interaural-polar elevations. Additional "special" measurements of the KEMAR mannequin were made for the frontal and horizontal planes. In addition, the database includes anthropometric measurements for use in HRTF scaling studies, technical documentation, and a utility program for displaying and inspecting the data. Additional information can be found in: V. R. Algazi, R. O. Duda, D. M. Thompson and C. Avendano, "The CIPIC HRTF Database," Proc. 2001 IEEE Workshop on Applications of Signal Processing to Audio and Electroacoustics, pp. 99-102. Other databases include the Listen HRTF database (Room Acoustics Team, IRCAM), the Acoustics Research Institute, HRTF Database, and the ITA Artificial Head HRIR Dataset (Institute of Technical Acoustics at RWTH Aachen University, among others.

Torso Modeling

As shown in FIG. 4, the structural HRIR model 115 also includes a torso model component 404. The system models the acoustic scatter reflected off of the torso (typically the shoulder) and directed up towards the ear. Thus two signals arrive at the ear, the first being the direct signal from the source, and the second being the reflected signal from the torso. In an embodiment, the model process 115 works by computing a single direction that represents an aggregation of all torso reflections. Both the head and the torso are modeled as simple spheres where the torso has a radius that is approximately twice the radius of the head, though other ratios are also possible. This simplified arrangement allows the calculation of a single vector that represents the aggregate reflection of all acoustic wave-fronts arriving from the direction of the torso. In reality the reflection is diffuse where the diffuseness is a function of the angle of arrival, and such diffusion will be addressed later with a separate algorithm. The three parameters associated with the torso reflection vector are direction, level, and time delay. Of these three, level is a free parameter and can be set heuristically. The direction and time delay are functions of the angle of inclination of the source vector. In an embodiment, analysis is done in terms of vectors, due to the directional nature of the quantities being computed. It should be noted that as per the coordinate system shown in FIG. 3, the coordinates of the calling function are expressed in polar coordinates. In certain cases, it may be expedient to compute the quantities associated with the shoulder reflection in terms of rectangular coordinates, where +x points to the left, +y points straight ahead (relative to the head), and +z points straight up. Thus the elevation and azimuth angles are converted to rectangular coordinates at the beginning of the shoulder reflection tool, and the resultant directional vector (the output) is converted to polar coordinates before passing the reflected direction to the calling function. In an embodiment, certain vector analysis tools are used for estimating the aggregate reflection vector of diffracted sound waves arriving from the torso.

Figure 10:
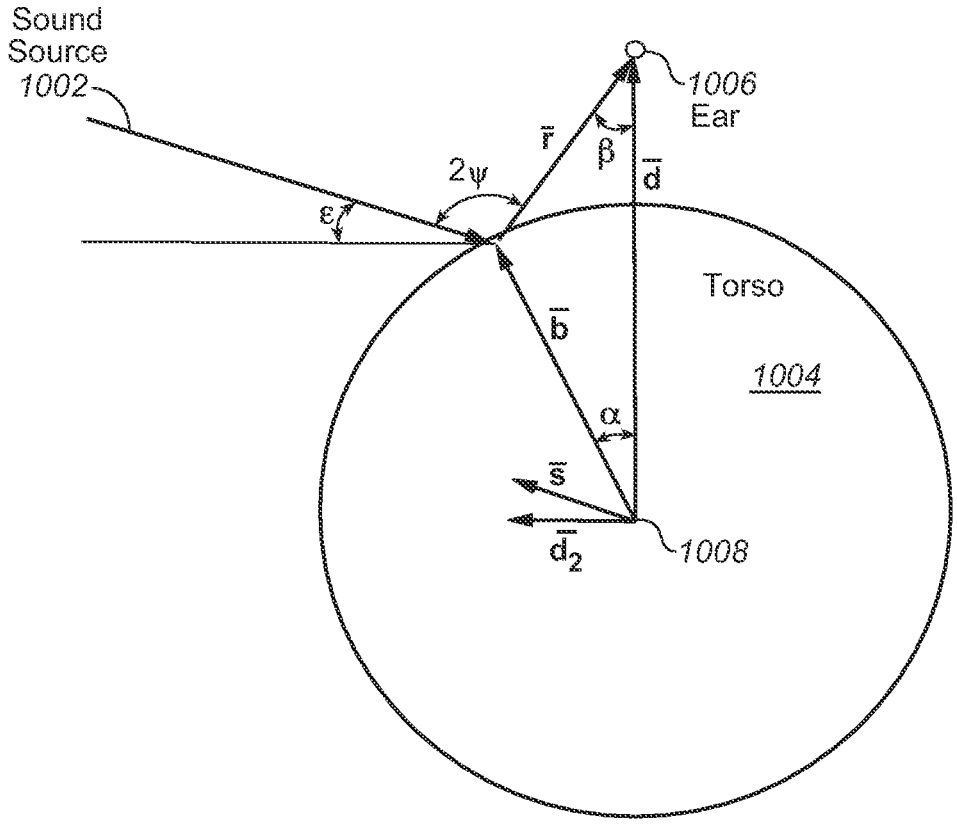
FIG. 10 illustrates a diagram of vectors related to torso reflection as used in a structural HRIR model, under an embodiment.

FIG. 10 illustrates a diagram of vectors related to torso reflection as used in a structural HRIR model, under an embodiment. FIG. 10 shows a sound source 1002 located a distance from a torso 1004 that has a defined center point 1008 at a distance to the model person's ear 1006. The elevation and azimuth angles are input variables to the torso model, and the elevation is the same as angle ε in FIG. 10; d is the vector between the center of the torso 1004 and the ear 1006, s is the unit vector in the direction of the sound source 1002, b is the vector to the point of reflection, and r is the output vector, which is the direction of the reflected vector. A key concept illustrated in FIG. 10 is that the vector b divides the angle 2ψ equally such that the angle between b and r (or s) is ψ for any elevation angle. This is true for any elevation angle. This thus establishes the relationship between s (or the elevation angle) and the direction of b, and in turn the direction of b determines the direction of r, i.e., the reflected wave-front from the torso.

For the torso model, the equations are derived as follows: $d_2$ is the vector orthogonal to d in the plane of s and d. Since r is the objective calculation, we calculate the unit vector r as the normalized vector difference between b and d. Note that we care only about the direction of r and not the magnitude of the vector.

$$\bar{r} = \frac{\bar{b} - \bar{d}}{\|\bar{b} - \bar{d}\|} \quad \text{Eq. 10}$$

In the above Eq. 10, $$\bar{b} = b\cos\alpha\frac{\bar{d}}{d} + b\sin\alpha\frac{\bar{d}_2}{\|\bar{d}_2\|},$$
$$\bar{d}_2 = d^2\bar{s} - (\bar{d}\cdot\bar{s})\bar{d}$$
$$d = \|\bar{d}\|, \quad b = \|\bar{b}\| = \text{torso_radius}$$

The direction of b is thus dependent on α, which is dependent on the angle of elevation ε; s is the unit vector in the direction of the source 1002 (which is the rectangular-to-polar conversion of the source elevation and azimuth); and d is the specified vector from the center 1008 of the torso 1004 to the ear 1006, where the position of the ear is specified with respect to the head sphere. The vector $d_2$ is a vector that is orthogonal to d, and lies in the plane formed by s and d. It should be noted that α can be estimated as a function of ε, according to Eq. 11:

$$\alpha = \begin{cases} \alpha_0 - \left(1 - \frac{\alpha_0}{\alpha_{MAX}}\right)\varepsilon & \text{if } -\alpha_{MAX} \le \varepsilon \le 0 \\ \alpha_0\left(1 - \frac{\varepsilon}{\pi/2}\right) & \text{if } 0 \le \varepsilon \le \pi/2 \end{cases} \quad \text{Eq. 11}$$

where $$\alpha_0 = \frac{\pi}{2}\cdot\frac{A-1}{2A-1}, \quad \alpha_{MAX} = \cos^{-1}\frac{1}{A}, \quad A = \frac{d}{b}$$

This provides the derivation of the directional vector for the torso reflection. It should be noted regarding the torso reflection vector that if the torso shadows the source vector, then the system does not consider any contribution from the torso. Given the fact that the source vector is constrained to not go below −45 degrees, this case is rarely if ever encountered in practical use.

Figure 11:
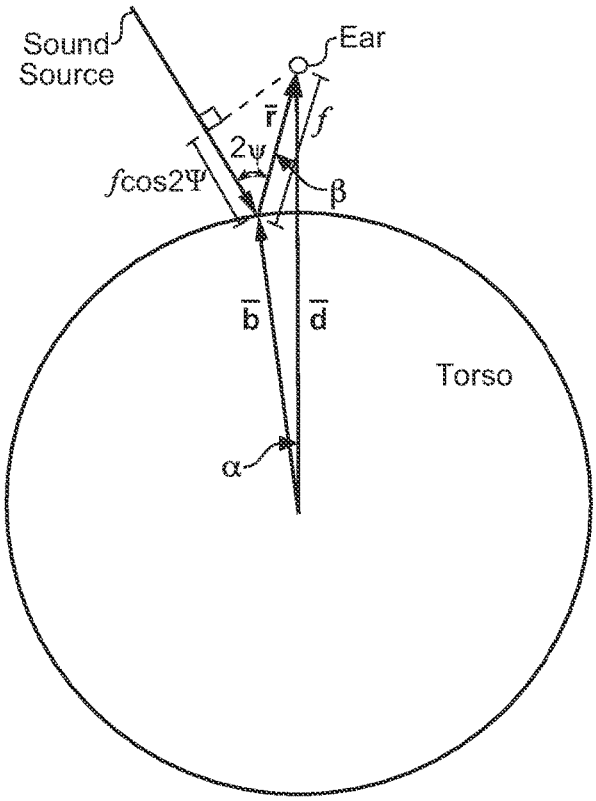
FIG. 11 illustrates the time delay incurred by torso reflection, for use in the structural HRIR model.

For the model, it is next necessary to compute the time delay associated with the time it takes the wave-front to reflect off the torso and arrive at the ear. FIG. 11 illustrates the time delay incurred by torso reflection, for use in the structural HRIR model. As shown in FIG. 11, the delay is expressed as f cos 2ψ+f, which is the additional distance the reflected wave must travel relative to the direct signal. Thus the time delay is this distance divided by the speed of sound c is as shown in Eq. 12:

$$\Delta T = \frac{f(\cos 2\psi + 1)}{c} \quad \text{Eq. 12}$$

where it can be shown using geometry that, $$\psi = \alpha + \beta, \quad \beta = \tan^{-1}\frac{b\sin\alpha}{d - b\cos\alpha}$$

Referring to FIG. 11, the expression for β can be found by forming a right triangle with b as the hypotenuse, and the base as the projection of b onto d, or b cos α. The side opposite α then is b sin α. Once the angular direction and delay are calculated, the vector r is converted to polar coordinates and the head model filter that is used for the direct path is computed. The torso reflection impulse response is filtered by applying the correct pinna responses for the calculated torso direction vector.

Figure 12:
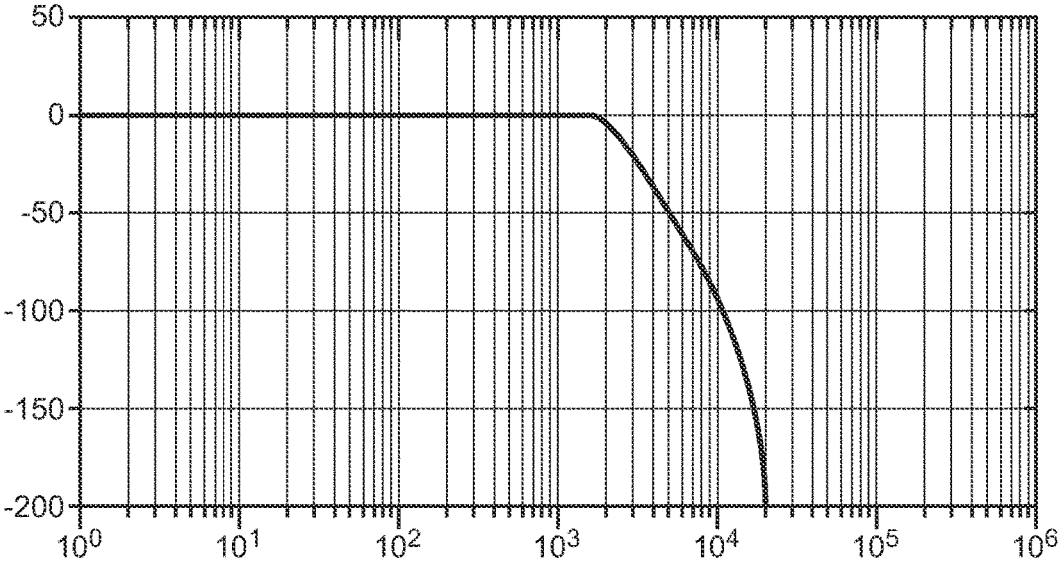
FIG. 12 illustrates an example filter magnitude response curve for a torso reflection lowpass filter, under an embodiment.

After filtering the torso reflection signal by the head model, the process applies shoulder reflection post-processing steps to limit the frequency response and to decorrelate the torso impulse response for certain elevations. By comparing the ripples caused by torso reflections, it has been observed that most of the effect on the magnitude response of the HRTF incurred by the torso reflection was a lowpass contribution to the overall response. Thus by applying a simple lowpass filter with non-varying filter coefficients, the ripple in the magnitude response caused by the inclusion of the torso reflection can be reduced. This ripple is caused by comb filtering, since the torso reflection is a delayed version of the direct signal. In an embodiment, lowpass filtering is applied to the torso reflection signal after it has been computed, to limit the ripple to frequencies below 2 kHz, which is more consistent with the observations of real datasets. This filter can be implemented using a 6-th order Butterworth, IIR filter with a magnitude response such as shown in FIG. 12. FIG. 12 illustrates an example filter magnitude response curve for a torso reflection lowpass filter, under an embodiment.

Since this filter will incur delay, the bulk wideband delay incurred by the lowpass filter is calculated and then subtracted from the torso reflection delay as shown in the following equation:

$$\Delta T' = \Delta T - \Delta T_{LP} \quad \text{Eq. 13}$$

In an example case, the delay $\Delta T_{LP}$ due to the filter was found to be 17 samples for a 44.1 kHz sample rate.

Figure 13:
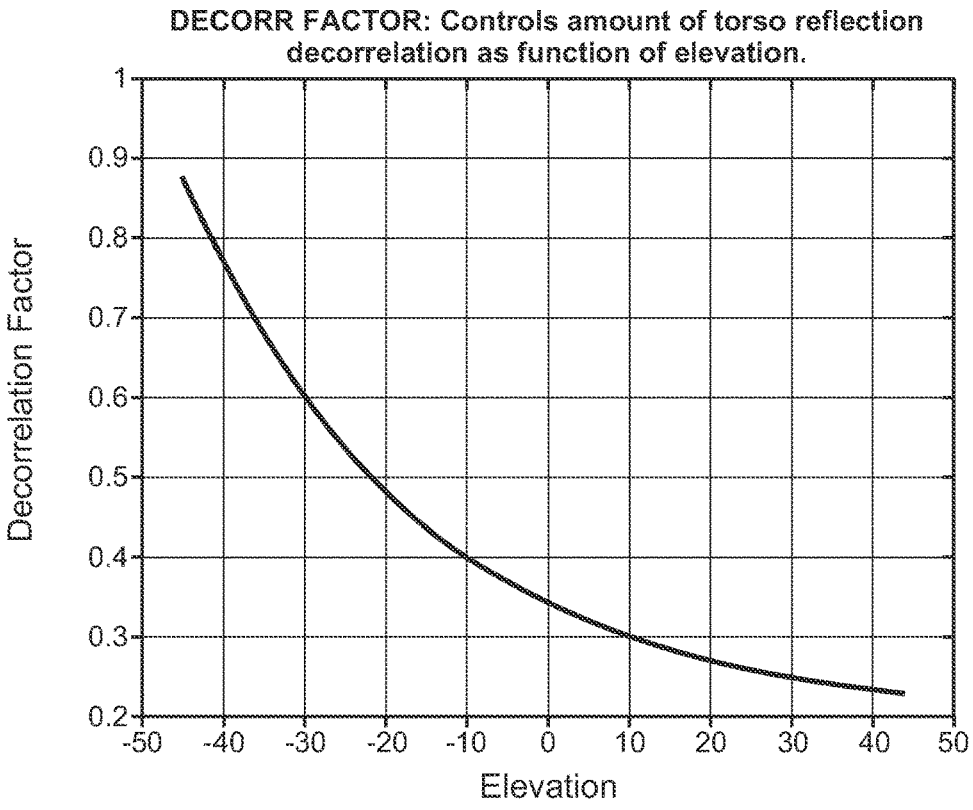
FIG. 13 illustrates diffusion as a function of elevation for a diffusion network applied to a torso reflection impulse response, under an embodiment.

In an embodiment, a diffusion network is applied to the torso reflection impulse response, conditioned on the elevation. For elevations near or below the horizon (elevation <0 degrees) the signal will arrive tangentially (or near tangentially) to the torso and any acoustic energy that arrives at the ear will be heavily diffuse due to the acoustic scattering of the wave-front reflecting from the torso. This is modeled in the system with a diffusion network of which the degree of diffusion applied varies as a function of elevation as shown in FIG. 13. FIG. 13 illustrates diffusion as a function of elevation for a diffusion network applied to a torso reflection impulse response, under an embodiment.

In an embodiment, the diffusion network is comprised of four allpass filters with varying delays, connected in a serial configuration. Each allpass filter is of the form:

$$AP_n(\text{ear}) = \frac{g + z^{-D(ear,n)}}{1 + gz^{-D(ear,n)}}, \quad 0 < n \le 4 \quad \text{Eq. 14}$$

$$H'(ear)_{TORSO} = \sqrt{1 - DMIX(el)^2}\, H(ear)_{TORSO} + DMIX(el)AP_4(\text{ear})$$

In the above equations, $AP_4$(ear) is the output of the last allpass network in the series. For the left ear, D=[3, 5, 7, 11], while for the right ear, D=[5, 7, 11, 13]. The input to each stage is scaled by 0.9 in order to dampen down the tail of the reverb. Finally the mix between the allpass output, and the direct, non-reverberant signal is controlled by the diffusion mix, DMIX(el).

Pinna Modeling

As further shown in FIG. 4, the structural HRIR model 115 also includes a pinna model component 406. It has been proposed that the outer ear acts as a reflector that introduces delayed replications (i.e., echoes) of the arriving wavefront. Studies have shown that similarities exist between the frequency response measurements made of the outer ear and the comb-filter effects of reflections. It has also been shown that a model of two such echoes can produce elevation effects.

Figure 14:
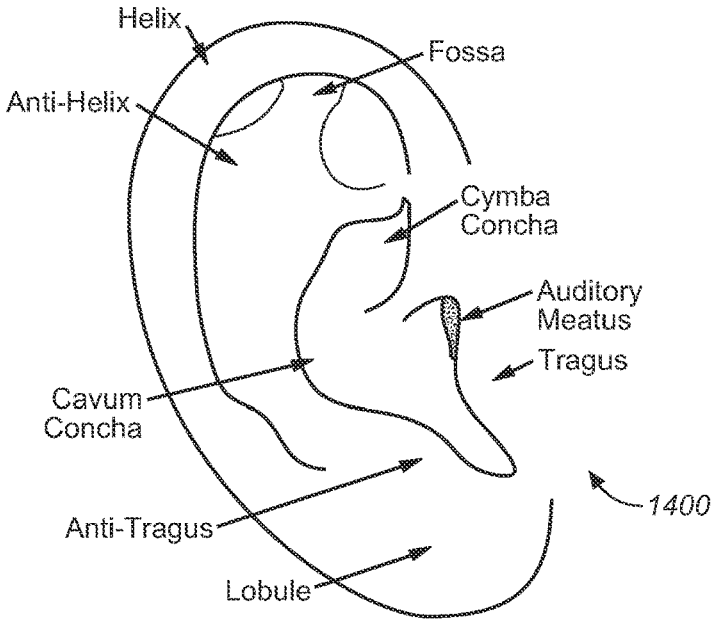
FIG. 14 illustrates a pinna and certain parts that are used in a pinna modeling process, under an embodiment.

In general, the pinna is the visible part of the ear that protrudes from the head and includes several parts that collect sounds and perform the spectral transformations that enable localization. FIG. 14 illustrates a pinna and certain parts that are used in a pinna modeling process, under an embodiment. The cavum concha is the primary cavity of the pinna, and as such contributes to the reflections seen as notches in the frequency domain. These notches vary with both azimuth and elevation. Additionally, there is a spectral feature which varies from front to back, and which has been shown to be attributed to the overall shadow caused by the pinna. Independent of elevation (and consequently front-to-back) there is an additional effect that only varies with azimuth. This is called the "pinna resonance" and, while it only has a weak dependence on azimuth, it does vary nonetheless.

The pinna resonance is determined by looking at a single cone of confusion for any given azimuth and averaging over all elevations. This results in an overall spectral shape as a function of azimuth. This shape includes ILD, which is then removed using the head model described earlier. The residual is the average contribution of just the pinna at that azimuth, which is then modeled using a low order FIR filter. Azimuths may then be sub-sampled (for example, every 10 degrees) and the FIR filter interpolated accordingly. Note that at the extreme azimuths (90 degrees) all elevations are the same, and so there is no true averaging and the pinna resonance filters have more detail than azimuths closer to the median plane.

Figure 20:
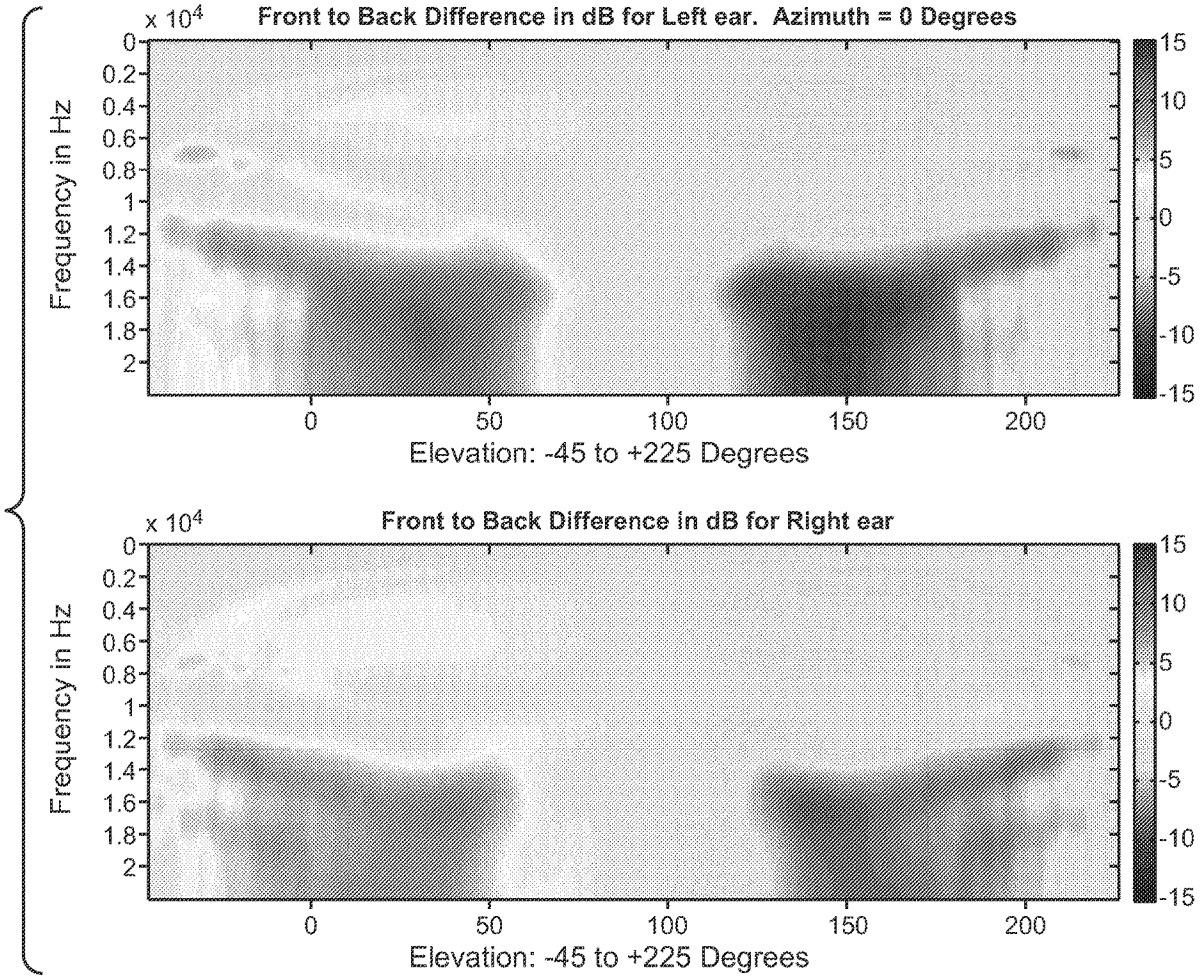
FIG. 20 illustrates a front/back difference plot for the ITA dataset.

With regard to the pinna shadow, similar to the left/right difference filters that were described earlier, front/back filters were calculated to model the acoustic attenuation incurred by the pinna (and in particular the helix of the pinna). It was observed that the pinna shadows acoustic energy arriving from behind the head. This difference was computed for equal, but opposite in sign values of elevation. The front/back difference magnitude response is shown in FIG. 20 for the median plane. This is across all elevations (x-axis) from −45 in the front to +225 degrees behind the head. FIG. 20 illustrates a front/back difference plot for the ITA dataset.

Figure 15:
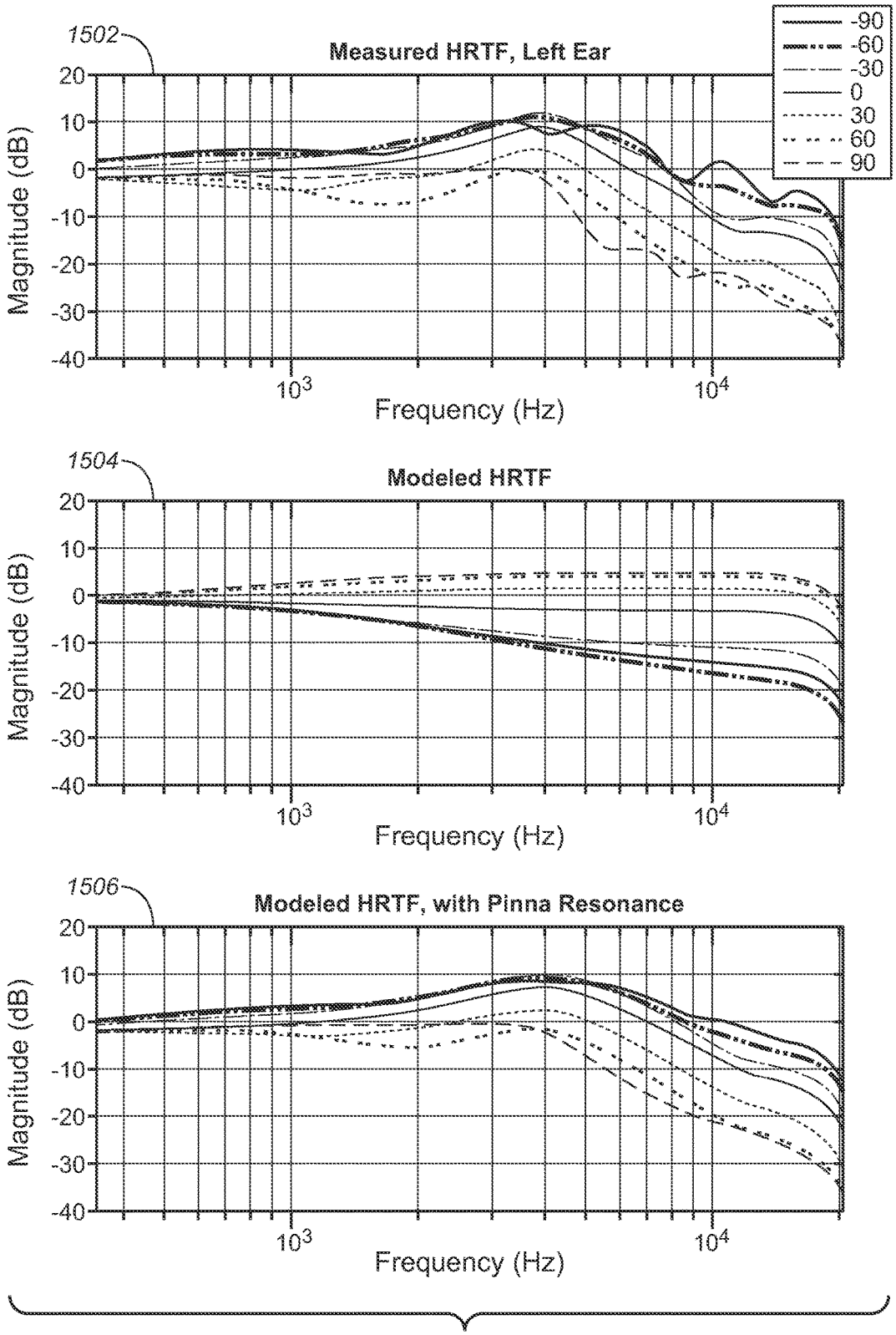
FIG. 15 illustrates frequency plots comparing measured and modeled HRTF spherical head models with reference to a modeled HRTF with pinna resonance.

FIG. 15 illustrates frequency plots comparing measured 1502 and modeled 1504 HRTF spherical head models with reference to a modeled HRTF with pinna resonance 1506. The equations used to derive the front/back differences are as follows:

$$\mathrm{HRTF}_F(\mathrm{ear,az,el})=\mathrm{TILT}_F(\mathrm{HRTF}(\mathrm{ear,az,el})-\mathrm{HRTF}(\mathrm{ear,az.180-el}))$$

$$\mathrm{HRTF}_B(\mathrm{ear,az,el})=(1-\mathrm{TILT}_F)(\mathrm{HRTF}(\mathrm{ear,az,el})-\mathrm{HRTF}(\mathrm{ear,az,180-el})) \qquad \text{Eq. 15}$$

In the above equations, −90<az<90 degrees, and −45<el<90 degrees, ear=left or right ear. The TILT factor specifies how much of the difference is applied as a boost to the front elevations (in front of the head), versus how much of a level cut should be applied to the back elevations (behind the head). This is a constant for the purposes of computing $\mathrm{HRTF}_F$ and $\mathrm{HRTF}_B$ across all elevations and azimuths.

For the front/back difference filters, FIR filters are derived directly from the forced minimum-phase magnitude responses. These filters are derived as follows:

$$BR_F(\mathrm{ear,az,el},t)=w(t)FFT^{-1}[MINPH\{\mathrm{HRTF}_F(\mathrm{ear,az,el})\}]$$

$$BR_B(\mathrm{ear,az,el},t)=w(t)FFT^{-1}[MINPH\{\mathrm{HRTF}_B(\mathrm{ear,az,el})\}] \qquad \text{Eq. 16}$$

Where w and MINPH are the same as previously defined earlier in this description.

Since pinna shadowing is common across all people, the front/back difference magnitude response of all subjects can be averaged for the available datasets. In an embodiment, the front/back difference filters are generated based on the average magnitude response with equal weightings to the three sources of data. Examples of three HRTF datasets used in the analysis include the ITA, Listen, and ARI datasets. The ITA dataset is based on the acoustic measurements of a single manikin, while the other datasets are based on measurements of multiple human subjects.

The front/back filters will generally boost the front elevations and cut the back elevations. This boost and cut is principally for frequencies above 10 kHz, although there is also a perceptually significant region between 2 and 6 kHz, wherein between 0 and 50 degrees elevation in the front a boost is applied, and in the corresponding region between 150 and 200 degrees elevation in the back a cut is applied. The dynamic range of the front/back filter may be adjusted to apply an additional 3.5 dB of boost in the front and cut in the back. This value may be experimentally arrived at by a method of adjustment, in which subjects adjust front/back dynamic range of the system while listening to test items played first through the system, and then through a loudspeaker placed directly in front them. The subjects adjust the dynamic range of the front/back filter to match that of the loudspeaker, and an average is then computed across a number of subjects. In one example case, this experiment resulted in setting the dynamic range adjustment figure to 3.5 dB though it should be noted that the variance across subjects was very high, and therefore, other values can be used as well.

After all subjects are averaged together to get the aggregate front/back difference magnitude response, further conditioning may be applied to the average magnitude response. In particular the average contains torso reflection components for frequencies below 2 kHz. Since the model contains a dedicated tool to apply torso reflection, the torso reflection components are removed from the front/back difference magnitude response. This may be accomplished by forcing the magnitude response to 0 dB below 2 kHz. A smooth cross-fade is applied between this frequency range, and the non-affected frequency range. The cross-fade is applied between 2 and 4 kHz. Likewise for elevations that would boost the gain above 0 dB at Nyquist, the gain is faded down such that the gain is 0 dB at Nyquist. This fade is applied between 20 to 22.05 kHz (for a sample rate of 44.1 kHz).

The final term needed in the derivation of the front/back difference filters is for the tilt factor. As mentioned above, the tilt term determines how much cut to apply in the back, versus how much boost to apply in the front. The sum of the boost and cut terms are defined to equal 1.0. A least-squares analysis was formulated in which the aggregate HRTF as computed by averaging across a number (e.g., three) of datasets, is compared to the model with the front/back filter applied. Using a simple brute-force search strategy, an optimal tilt value was found that minimizes the error between the average HRTF across the datasets, and the model, as follows:

$$\text{Objective} = \min(\text{err}(\text{tilt})), \quad \text{for } 0.0 > \text{TILT} > 1.0 \qquad \text{Eq. 17}$$

$$\text{err}(\text{TILT}) = \sum_{az=AZ} \sum_{el=EL} \sum_{f=1:128} [Ag(az, el, f) - M(az, el, f, \text{TILT})]^2$$

Figure 16:
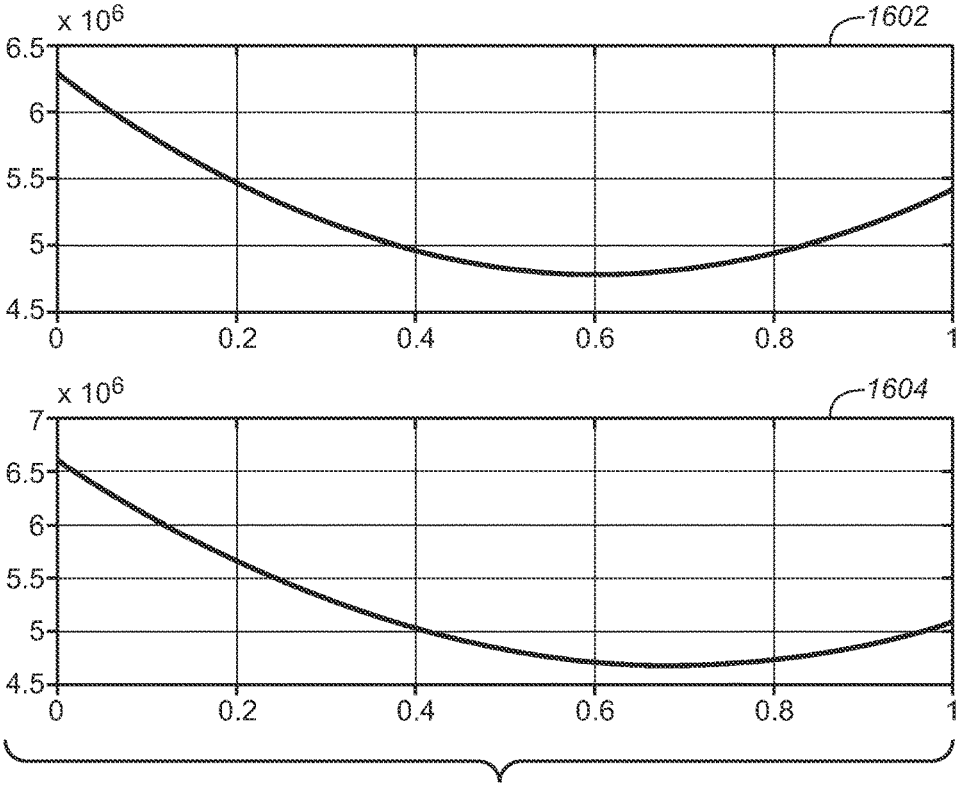
FIG. 16 illustrates front/back tilt error as a function of the TILT parameter, under an embodiment.

In the above equations, TILT is the candidate tilt value that minimizes err, Ag is the averaged HRTF across all subjects in the datasets, and M is the model (with the pinna notch and torso tools disabled). Using a step size (e.g., of 0.05) to increment the tilt value from 0 to 1.0, an error curve, such as shown in FIG. 16 is derived. FIG. 16 illustrates front tilt 1602 and back tilt 1604 error as a function of the TILT parameter, under an embodiment. As can be seen in FIG. 16, the optimal value for TILT in the illustrated example is 0.65. Thus, for this case, TILT has been set to 0.65 in the calculation of the front/back filters. Although the error minimization of the TILT metric is determined by minimizing the square of the difference between the measured and modeled datasets, it will be obvious to one of ordinary skill that other error metrics may be used.

The front/back filter impulse response values are saved into a table that is indexed according to the elevation and azimuth index. When the model is running, the front/back impulse response coefficients are read from the table and convolved with the current impulse response of the model, as computed up to that point. The spatial resolution of the front/back table may be variable. If the resolution is less than one degree, then spatial interpolation is performed to compute the intermediate front/back filter coefficient values. Interpolation of the front/back FIR filters is expected to be better behaved than the same interpolation applied to HRIRs. This is because there is less spectral variation in the front/back filters than exists in HRIRs for the same spatial resolution.

In an embodiment, the pinna model component 406 includes a module that processes pinna notches. In general, the pinna works differently for low and high frequency sounds. For low frequencies it directs sounds toward the ear canal, but for high frequencies its effect is different. While some of the sounds that enter the ear travel directly to the canal, others reflect off the contours of the pinna first, and therefore enter the ear canal with a slight delay, which translates into phase cancellation, where the frequency component whose wave period is twice the delay period is virtually eliminated. Neighboring frequencies are dropped significantly, thus resulting in what is known as the pinna notch, where the pinna creates a notch filtering effect. In an embodiment, the structural HRIR model models the frequency location of pinna notches as function of elevation and azimuth. In general, the ILD and ITD cues are not sufficient to localize objects in 3D space. For a given azimuth position, the ITD and ILD values are identical as one varies the elevation from −45 to 225 degrees assuming an inter-aural coordinate system as described above. This set of points is usually referred to as the cone of confusion. To resolve two locations on the cone of confusion, one relies on the frequency locations of various pinna notches. The frequency location of the pinna notch is dependent on the source elevation at a given azimuth.

Figure 17:
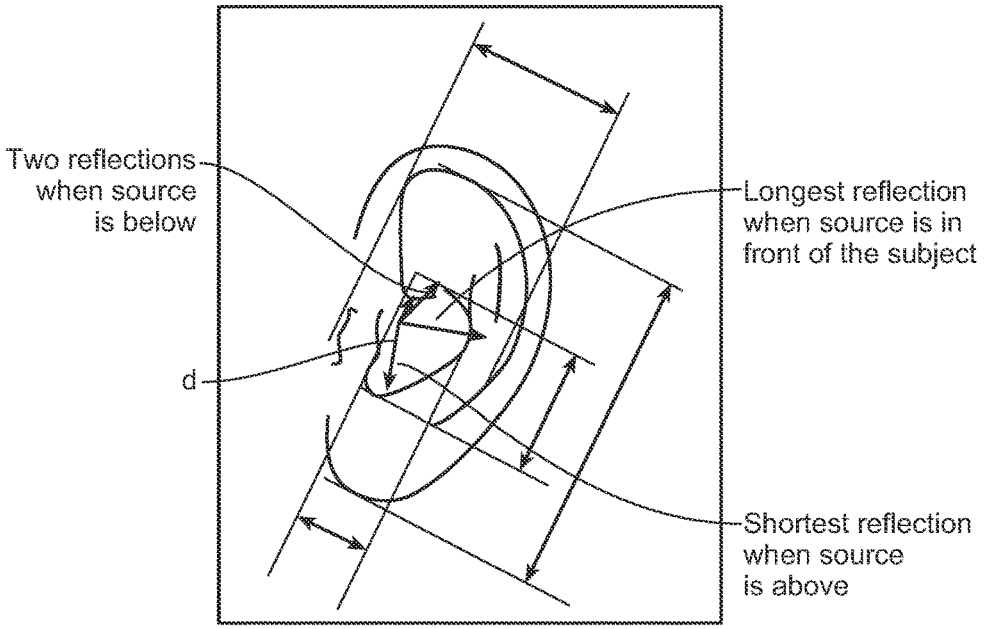
FIG. 17 illustrates notches resulting from Pinna reflections and as accommodated by the structural HRIR model, under an embodiment.

FIG. 17 illustrates notches resulting from pinna reflections and as accommodated by the structural HRIR model, under an embodiment. For the diagram of FIG. 17, it is assumed that the source is at elevation 90-degrees (above the head) for a given azimuth. For that position of the source, consider the following two waves: (1) a direct wave that enters the ear-canal, and (2) a wave that is reflected from the bottom of the concha and travels an additional distance of twice the distance from the bottom of the concha to the entrance of the ear canal (meatus). For destructive interference of these two waves, the following equation holds true: $2d=\lambda/2$, $2d=c/2f$, and $d=c/4f$. Here 'd' is the distance of the reflecting structure of pinna from the ear-canal entrance, 'c' is the speed of sound and 'f' is frequency at which destructive interference happens resulting in a notch in the spectrum. Thus, as the sound source's elevation changes, the distance ('d') of the reflecting surface on the pinna to the ear canal entrance changes. This results in corresponding pinna notch locations for different elevations of the sound source.

As described above, the frequency location of notches in the HRTF (Head-Related Transfer Function) is a result of destructive interference of reflected waves from different parts of the pinna as the elevation of the sound source changes. In an embodiment, the pinna notch locations are modeled. For a given azimuth, the process tracks several notches across elevations using a sinusoidal tracking algorithm. Each track is then approximated using a third order polynomial of elevation values. For instance, each track corresponding to a notch at a given azimuth value (az) can be represented using a tracked pair of values $\{(f_{1_az}, e_{1_az}), (f_{2_az}, e_{2_az}), \ldots (f_{n_az}, e_{n_az})\}$. Here $(f_{i_az}, e_{i_az})$ represents that the notch location is $f_{i_az}$ at $e_{i_az}$ for azimuth at az. Similarly, the track for the same notch at (az−1) can be represented as $\{(f_{1_(az-1)}, e_{1_(az-1)}), (f_{2_(az-1)}, e_{2_(az-1)}), (f_{n1_(az-1)}, e_{n1_(az-1)})\}$ and (az+1) as $\{(f_{1_(az+1)}, e_{1_(az+1)}), (f_{2_(az+1)}, e_{2_(az+1)}), (f_{n2_(az+1)}, e_{n2_(az+1)})\}$. Note the number of two-tuples for (az−1) is n1, which may be different from the number of tracked notch locations (n) for az.

The process next forms a vector of frequency values (f) and corresponding elevation values (e) by combining the information from three neighboring tracks of a notch at (az−1, az, az+1). Therefore, f is a vector that has the following (n+n1+n2) elements $(f_{1_az}, f_{2_az}, \ldots f_{n_az}, f_{1_(az-1)}, f_{2_(az-1)}, \ldots f_{n1_(az-1)}, f_{1_(az+1)}, f_{2_(az+1)}, \ldots f_{n2_(az+1)})$. Similarly, the vector e has the following elements: $(e_{1_az}, e_{2_az}, \ldots e_{n_az}, e_{1_(az-1)}, e_{2_(az-1)}, \ldots e_{n1_(az-1)}, e_{1_(az+1)}, e_{2_(az+1)}, \ldots e_{n2_(az+1)})$. What is needed is a function $\varphi(e)$ for each az that maps a given elevation value to a notch location in Hz. If $\varphi(e)$ is a third order polynomial in e (i.e., $\varphi(e)=a_3 e^3+a_2 e^2+a_1 e+a_0$), then a matrix equation can be written as: $E a=f$, where E is a matrix of 4 columns and (n+n1+n2) rows. Column 'i' of matrix E is $e^{(3-(i-1))}$. a is vector of 4 parameters $(a_3, a_2, a_1, a_0)$ (that we seek to estimate). The least squares solution to the parameter vector a is $(E^T E)^{-1}(E^T f)$.

The above-described method estimates a polynomial function of elevation values that specifies the location of the notch for a given azimuth. For the complete model for pinna notch location, the process estimates one polynomial function for each of the following notches:

a. $\Phi_{az}^{notch1}(e)$ to predict notch1 locations at azimuth value az for elevation values between −45 and 90 at that azimuth.

b. $\Phi_{az}^{notch2}(e)$ to predict notch2 locations at azimuth value az for elevation values between −45 and 90 at that azimuth.

c. $\Phi_{az}^{notch3}(e)$ to predict notch3 locations at azimuth value az for elevation values between 90 and 225 at that azimuth.

d. $\Phi_{az}^{notch4}(e)$ to predict notch4 locations at azimuth value az for elevation values between 90 and 225 at that azimuth.

Figure 18:
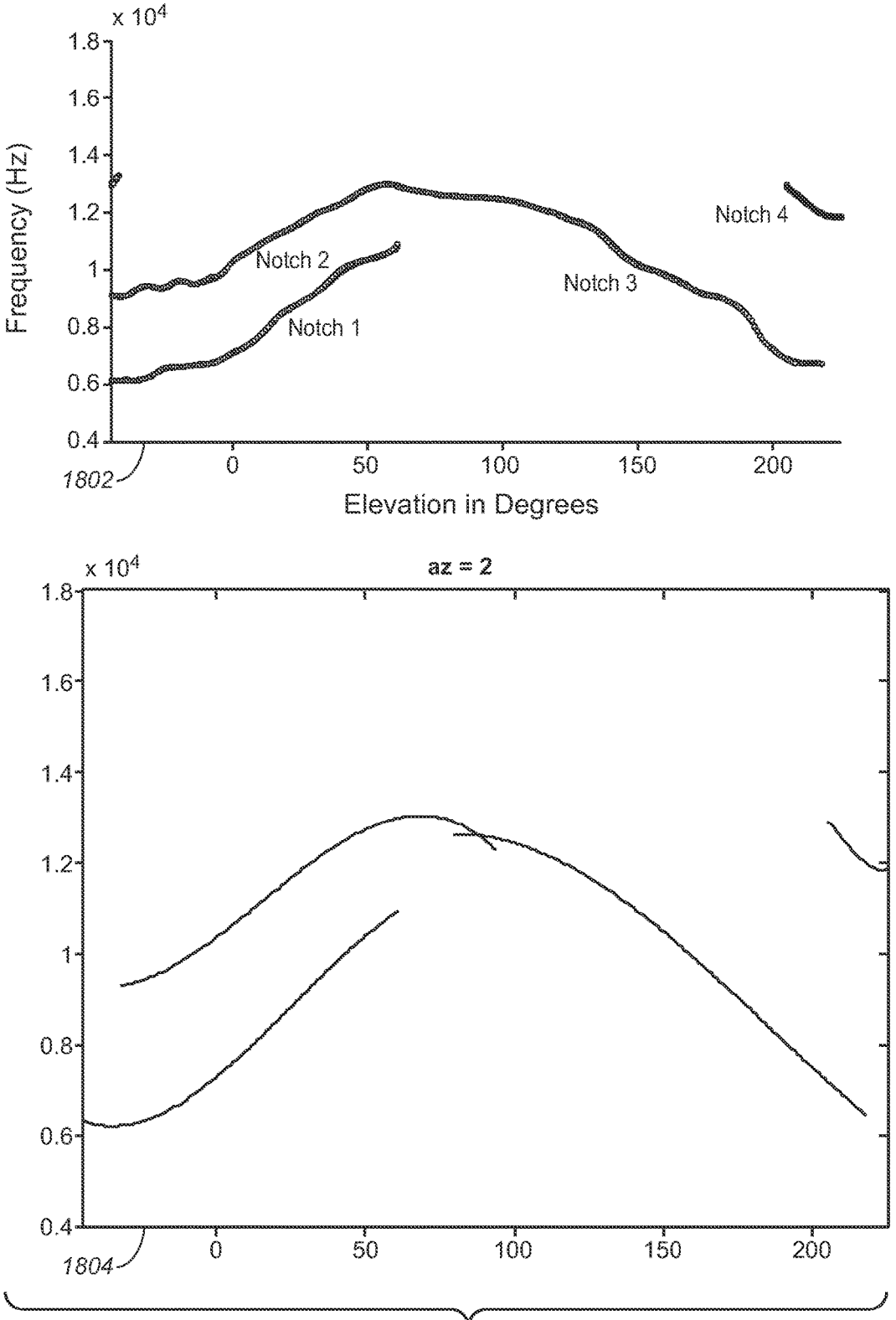
FIG. 18 illustrates the modeling of four pinna notches using polynomials, under an embodiment.

FIG. 18 illustrates the modeling of four pinna notches using the above polynomials, under an embodiment.

Figure 19:
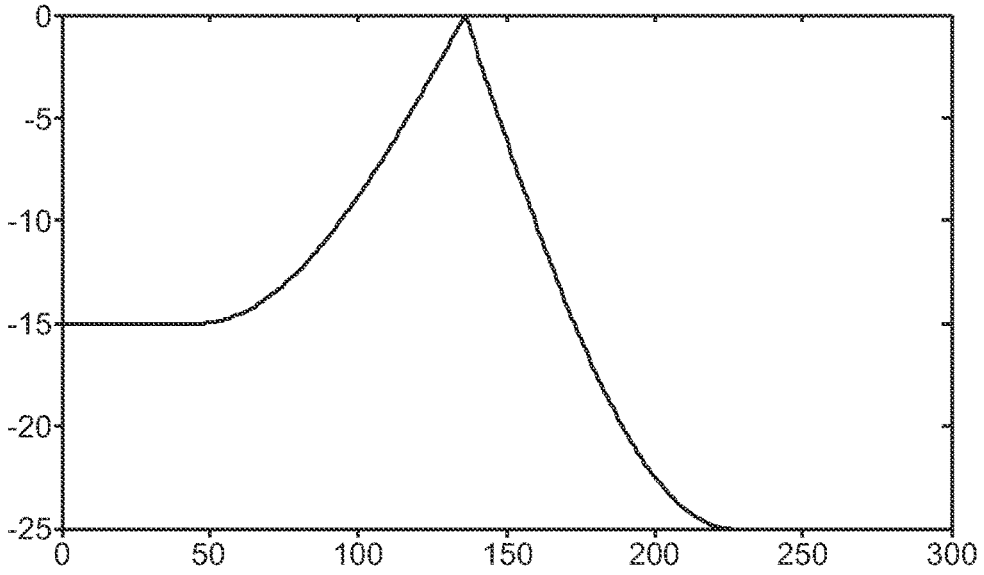
FIG. 19 illustrates the depth of the four pinna notches of FIG. 18 as a function of elevation.

While the above-mentioned four functions describe the frequency location of the four pinna notches as a function of elevation, a simple model for the depth of these notches as a function of elevation can be used, as shown in FIG. 19. FIG. 19 illustrates the depth of the four pinna notches of FIG. 18 as a function of elevation. Note that the depth of the notch is 10 dB higher in the front (−45 to 0) than the depth in the back (180 to 225). This also helps with front-back differentiation, as the sound source would be brighter in the front versus the back.

Embodiments of the structural HRIR model may be used in an audio content production and playback system that optimizes the rendering and playback of object and/or channel-based audio over headphones. A rendering system using such a model allows the binaural headphone renderer to efficiently provide individualization based on interaural time difference (ITD) and interaural level difference (ILD) and sensing of head size. As stated above, ILD and ITD are important cues for azimuth, which is the angle of an audio signal relative to the head when produced in the horizontal plane. ITD is defined as the difference in arrival time of a sound between two ears, and the ILD effect uses differences in sound level entering the ears to provide localization cues. It is generally accepted that ITDs are used to localize low frequency sound and ILDs are used to localize high frequency sounds, while both are used for content that contains both high and low frequencies. Such a renderer may be used in spatial audio applications in which certain sound source cues are virtualized. For example, sounds intended to be heard from behind the listeners may be generated by speakers physically located behind them, and as such, all of the listeners perceive these sounds as coming from behind. With virtual spatial rendering over headphones, perception of audio from behind is controlled by head related transfer functions (HRTF) that are used to generate the binaural signal. In an embodiment, the structural HRIR model may be incorporated in a metadata-based headphone processing system that utilizes certain HRTF modeling mechanisms based on the structural HRIR model. Such a system could be tuned or modified according to anthropometric features of the user. Other benefits of the modular approach allow for accentuating certain features in order to amplify specific spatial cues. For instance, certain cues could be exaggerated beyond what an acoustic binaural filter would impart to an individual. The system also facilitates rendering spatial audio through low-power mobile devices that may not have the processing power to implement traditional HRTF models.

Systems and methods are described for developing a structural HRIR model for virtual rendering of object-based content over headphones, and that may be used in conjunction with a metadata delivery and processing system for such virtual rendering, though applications are not so limited. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the methods and systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method for generating, using a computational signal processing model, coefficients of a head-related impulse response (HRIR) filter usable in rendering audio for playback comprising:

receiving parameters describing the location of a sound source, wherein the parameters are defined relative to the position of a head of a listener;

determining a first set of filter coefficients from a spherical head component of the signal processing model in response to at least one of the parameters;

determining a second set of filter coefficients from a pinna component of the signal processing model in response to at least one of the parameters, wherein the pinna component of the signal processing model includes a front/back asymmetry model to account for a pinna shadowing effect;

determining a third set of filter coefficients from a torso component of the signal processing model in response to at least one of the parameters;

determining a fourth set of coefficients from a near-field component of the signal processing model in response to at least one of the parameters; and combining the first, second, third, and fourth sets of coefficients by convolution to generate the coefficients of the HRIR filter, wherein the front/back asymmetry model comprises:

for each ear, a front/back difference for front elevations in front of the head and a front/back difference for back elevations behind the head determined from a difference between responses for respective elevations that are mirror images of each other, mirrored at a frontal plane, wherein a tilt factor specifies how much of the difference between responses for respective elevations that are mirror images of each other is applied to the front/back difference for the front elevations to boost the front elevations and how much of the difference between responses for respective elevations that are mirror images of each other is applied to the front/back difference for the back elevations as a level cut to the back elevations, wherein the difference between responses for respective elevations that are mirror images of each other is a function of azimuth and elevation; and front/back difference filters for the front and back elevations computed from the front/back differences for the front and back elevations, respectively.

2. The method of claim 1 further comprising determining coefficients of a timbre preserving equalization filter and combining the coefficients of the timbre preserving equalization filter and the coefficients of the HRIR filter to generate coefficients of a timbre preserving HRIR filter.

3. A method for creating, using a computational signal processing model, a head-related impulse response (HRIR) usable in rendering audio for playback through headphones on the head of a listener comprising:

receiving location parameters for a sound based on a coordinate system that is relative to the center of the head;

applying a spherical head component of the signal processing model to the location parameters to generate binaural HRIR values;

computing a pinna component of the signal processing model using the location parameters and applying the pinna component of the signal processing model to the binaural HRIR values to generate pinna modeled HRIR values;

computing a torso component of the signal processing model using the location parameters and applying the torso component of the signal processing model to the pinna modeled HRIR values to generate pinna and torso modeled HRIR values; and computing a near-field component of the signal processing model using the location parameters and applying the near-field component of the signal processing model to the pinna and torso modeled HRIR values to generate pinna, torso and near-field modeled HRIR values, wherein computing the pinna component of the signal processing model comprises applying a front/back asymmetry model which imparts the response incurred by the pinna shadowing effect, and wherein the front/back asymmetry model comprises:

for each ear, a front/back difference for front elevations in front of the head and a front/back difference for back elevations behind the head determined from a difference between responses for respective elevations that are mirror images of each other, mirrored at a frontal plane, wherein a tilt factor specifies how much of the difference between responses for respective elevations that are mirror images of each other is applied to the front/back difference for the front elevations to boost the front elevations and how much of the of the difference between responses for respective elevations that are mirror images of each other is applied to the front/back difference for the back elevations as a level cut to the back elevations, wherein the difference between responses for respective elevations that are mirror images of each other is a function of azimuth and elevation; and front/back difference filters for the front and back elevations from the front/back differences for the front and back elevations, respectively.

4. The method of claim 3 further comprising:

utilizing in the spherical head component of the signal processing model a set of linear filters to approximate interaural time difference (ITD) cues for azimuth and elevation relative to the head of the listener; and applying a filter to the ITD cues to approximate interaural level difference (ILD) cues for the azimuth and elevation.

5. The method of claim 4 wherein computing the near-field component of the signal processing model further comprises:

fitting a polynomial to express the ILD cues as a function of frequency and range, for each azimuth;

calculating a magnitude response difference between near ear and far ear relative to a distance defined by a near-field range; and applying the magnitude response difference to a far field head related transfer function to obtain corrected ILD cues for the near-field range.

6. The method of claim 3 wherein the spherical head component of the signal processing model receives as inputs a unit impulse and one or more non-varying head parameters.

7. The method of claim 5 further comprising estimating one polynomial function each for the near ear and the far ear.

8. The method of claim 5 further comprising compensating for interaural asymmetry by:

computing differences between ipsilateral and contralateral responses for each of the near ear and the far ear; and computing minimum-phase finite impulse response filters by applying a finite impulse response filter function to the differences between ipsilateral and contralateral responses, which are functions of the azimuth over a range of elevations.

9. The method of claim 3 wherein computing the torso component of the signal processing model comprises computing a single direction of sound representing acoustic scatter off of the torso and directed up to the ear using a reflection vector comprising direction, level, and time delay parameters.

10. The method of claim 9 further comprising:

deriving a torso reflection signal using the direction, level, and time delay parameters using a filter model that models the head and torso as simple spheres with the torso of a radius approximately twice the radius of the head; and applying a shoulder reflection post-process including a low-pass filter to limit frequency response and decorrelate a torso impulse response for a defined range of elevations.

11. The method of claim 3 wherein computing the pinna component of the signal processing model comprises:

determining a pinna resonance for a given azimuth by averaging measured HRTF data for a plurality of elevations within a cone of confusion for the given azimuth; and determining a location of pinna notches by estimating a polynomial function of elevation values that specifies the location of a notch for the given azimuth, wherein the location of the notches are computed from the measured HRTF data using a feature tracking algorithm.

12. The method of claim 11 wherein the cone of confusion for the given azimuth comprises a set of points where ITD and ILD values are constant as the elevation varies across a defined range for the given azimuth.

13. A system for creating, using a computational signal processing model, a head-related impulse response (HRIR) for use in rendering audio for playback through headphones on the head of a listener comprising:

a rendering component to perform binaural rendering of a source audio signal for playback through the headphones; and a structural model component receiving location parameters, applying a spherical head component of the signal processing model to the location parameters to generate binaural HRIR values, computing a pinna component of the signal processing model using the at least some of the location parameters to apply to the binaural HRIR values to generate pinna modeled HRIR values, computing a torso component of the signal processing model using the at least some location parameters to apply to the pinna modeled HRIR values to generate pinna and torso modeled HRIR values; and computing a near-field component of the signal processing model using the azimuth and range parameters to apply to the pinna and torso modeled HRIR values to generate pinna, torso and near-field modeled HRIR values, wherein computing the pinna component of the signal processing model comprises applying a front/back asymmetry model which imparts the response incurred by the pinna shadowing effect, and wherein the front/back asymmetry model comprises:

for each ear, a front/back difference for front elevations in front of the head and a front/back difference for back elevations behind the head determined from a difference between responses for respective elevations that are mirror images of each other, mirrored at a frontal plane, wherein a tilt factor specifies how much of the difference between responses for respective elevations that are mirror images of each other is applied to the front/back difference for the front elevations to boost the front elevations and how much of the of the difference between responses for respective elevations that are mirror images of each other is applied to the front/back difference for the back elevations as a level cut to the back elevations, wherein the difference between responses for respective elevations that are mirror images of each other is a function of azimuth and elevation; and front/back difference filters for the front and back elevations from the front/back differences for the front and back elevations, respectively.

14. The system of claim 13 wherein the location parameters comprise azimuth, elevation, and range relative to a head of a listener.

15. The system of claim 13 wherein the audio is transmitted for playback through the headphones by a portable audio source device, and comprises channel-based audio having surround sound encoded audio and object-based audio having objects featuring spatial parameters.

16. The system of claim 13, wherein the rendered audio comprises channel-based audio and object-based audio including spatial cues for reproducing an intended location of a corresponding sound source in three-dimensional space relative to the listener.

17. The system of claim 15, wherein the portable audio source device is a portable electronic device selected from the group consisting of: an audio player, a video game player, a mobile phone, a portable computer, and a tablet computer.

18. The system of claim 15, wherein the pinna, torso and near-field modeled HRIR values comprise an HRIR model that is encoded as playback metadata generated by a rendering component, the HRIR model representing a head related transfer function (HRTF) of a desired position of one or more object signals in three-dimensional space relative to the listener.

19. The system of claim 18, wherein the playback metadata modifies content dependent metadata generated by an authoring tool operated by a content creator, and wherein the content dependent metadata dictates the rendering of an audio signal containing audio channels and audio objects.

20. The system of claim 18, wherein the content dependent metadata controls a plurality of channel and object characteristics selected from the group consisting of: position, size, gain adjustment, elevation emphasis, stereo/full toggling, 3D scaling factors, spatial and timbre properties, and content dependent settings.

* * * * *